US010222756B2

(12) United States Patent
Ely et al.

(10) Patent No.: US 10,222,756 B2
(45) **Date of Patent: *Mar. 5, 2019**

(54) COVER MEMBER FOR AN INPUT MECHANISM OF AN ELECTRONIC DEVICE

(71) Applicant: Apple Inc., Cupertino, CA (US)

(72) Inventors: Colin M. Ely, Sunnyvale, CA (US); Fletcher R. Rothkopf, Los Altos, CA (US); Maegan K. Spencer, Emerald Hills, CA (US)

(73) Assignee: APPLE INC., Cupertino, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/010,502

(22) Filed: Jun. 17, 2018

(65) Prior Publication Data

US 2018/0299834 A1 Oct. 18, 2018

Related U.S. Application Data

(63) Continuation of application No. 15/092,584, filed on Apr. 6, 2016, now Pat. No. 10,018,966.

(60) Provisional application No. 62/152,282, filed on Apr. 24, 2015.

(51) Int. Cl.

| | |
|---|---|
| ***G04C 3/00*** | (2006.01) |
| ***G04G 21/00*** | (2010.01) |
| ***G04B 3/04*** | (2006.01) |

(52) U.S. Cl.

CPC ..... *G04C 3/002* (2013.01); *G04B 3/041* (2013.01); *G04B 3/046* (2013.01); *G04G 21/00* (2013.01)

(58) Field of Classification Search

CPC ..... G04B 3/04; G04B 3/041; G04B 3/046; G04B 37/10; G04G 21/00; G04C 3/002

USPC ..... 368/308, 319–321

See application file for complete search history.

(56) References Cited

U.S. PATENT DOCUMENTS

| | | | |
|---|---|---|---|
| 2,237,860 | A | 4/1941 | Bolle |
| 2,288,215 | A | 6/1942 | Taubert et al. |
| 2,497,935 | A | 2/1950 | Feurer |
| 2,771,734 | A | 11/1956 | Morf |
| 2,788,236 | A | 4/1957 | Kafowi |
| 2,797,592 | A | 7/1957 | Marrapese |
| 3,040,514 | A | 6/1962 | Dinstman |

(Continued)

FOREIGN PATENT DOCUMENTS

| | | |
|---|---|---|
| CH | 1888928 | 1/1937 |
| CN | 1302740 | 9/2001 |

(Continued)

OTHER PUBLICATIONS

Author Unknown, "Desirable Android Wear smartwatch from LG," Gulf News, Dubai, 3 pages, Jan. 30, 2015.

(Continued)

*Primary Examiner* — Edwin A. Leon

(74) *Attorney, Agent, or Firm* — Brownstein Hyatt Farber Schreck, LLP

(57) ABSTRACT

A watch crown assembly has a body configured to receive rotary input. The body defines a recess and a retention feature. The watch crown assembly further comprises a ceramic member positioned at least partially in the recess and a mounting arm attached to the ceramic member. The mounting arm is engaged with the retention feature of the body, thereby retaining the ceramic member to the body.

20 Claims, 14 Drawing Sheets

(56) References Cited

U.S. PATENT DOCUMENTS 3,056,030 A 9/1962 Kelchner
3,130,539 A 4/1964 Davis
3,355,873 A 12/1967 Morf
3,410,247 A 11/1968 Dronberger
3,495,398 A 2/1970 Widmer et al.
3,577,876 A 5/1971 Spadini
3,621,649 A 11/1971 Vulcan et al.
3,662,618 A 5/1972 Kroll et al.
4,007,347 A 2/1977 Haber
4,031,341 A 6/1977 Wuthrich et al.
4,037,068 A 7/1977 Gaynor
4,077,200 A 3/1978 Schneider
4,133,404 A 1/1979 Griffin
4,170,104 A 10/1979 Yamagata
4,258,096 A 3/1981 LaMarche
4,287,400 A 9/1981 Kitik
4,289,400 A 9/1981 Kubola et al.
4,311,026 A 1/1982 Ochoa
4,311,990 A 1/1982 Burke
4,324,956 A 4/1982 Sakakino et al.
4,345,119 A 8/1982 Latasiewicz
4,364,674 A 12/1982 Tesch
4,379,642 A 4/1983 Meyrat
4,395,134 A 7/1983 Luce
4,396,298 A 8/1983 Ripley
4,417,824 A 11/1983 Paterson et al.
4,581,509 A 4/1986 Sanford et al.
4,600,316 A 7/1986 Besson
4,617,461 A 10/1986 Subbarao et al.
4,634,861 A 1/1987 Ching et al.
4,641,026 A 2/1987 Garcia, Jr.
4,670,737 A 6/1987 Rilling
4,766,642 A 8/1988 Gaffney et al.
4,783,772 A 11/1988 Umemoto et al.
4,884,073 A 11/1989 Souloumiac
4,914,831 A 4/1990 Kanezashi et al.
4,922,070 A 5/1990 Dorkinski
4,931,794 A 6/1990 Haag
4,952,799 A 8/1990 Loewen
4,980,685 A 12/1990 Souloumiac et al.
4,987,299 A 1/1991 Kobayashi et al.
5,034,602 A 7/1991 Garcia et al.
5,214,278 A 5/1993 Banda
5,258,592 A 11/1993 Nishikawa et al.
5,288,993 A 2/1994 Bidiville et al.
5,347,123 A 9/1994 Jackson et al.
5,383,166 A 1/1995 Gallay
5,471,054 A 11/1995 Watanabe
5,509,174 A 4/1996 Worrell
5,572,314 A 11/1996 Hyman et al.
5,583,560 A 12/1996 Florin et al.
5,631,881 A 5/1997 Pessey et al.
5,726,645 A 3/1998 Kamon et al.
5,748,111 A 5/1998 Bates
5,825,353 A 10/1998 Will
5,841,050 A 11/1998 Clift et al.
5,847,335 A 12/1998 Sugahara et al.
5,867,082 A 2/1999 Van Zeeland
5,943,233 A 8/1999 Ebina
5,953,001 A 9/1999 Challener et al.
5,960,366 A 9/1999 Duwaer et al.
5,963,332 A 10/1999 Feldman et al.
6,069,567 A 5/2000 Zawilski
6,134,189 A 10/2000 Carrard
6,154,201 A 11/2000 Levin et al.
6,175,679 B1 1/2001 Veligdan et al.
6,246,050 B1 6/2001 Tullis et al.
6,252,825 B1 6/2001 Perotto
6,304,247 B1 10/2001 Black
6,355,891 B1 3/2002 Ikunami
6,392,640 B1 5/2002 Will
6,396,006 B1 5/2002 Yokoji et al.
6,422,740 B1 7/2002 Leuenberger
6,477,117 B1 11/2002 Narayanaswami et al.
6,502,982 B1 1/2003 Bach et al.
6,525,278 B2 2/2003 Villain et al.
6,556,222 B1 4/2003 Narayanaswami
6,575,618 B1 6/2003 Inoue et al.
6,587,400 B1 7/2003 Line
6,646,635 B2 11/2003 Pogatetz et al.
6,661,438 B1 11/2003 Shiraishi et al.
6,672,758 B2 1/2004 Ehrsam et al.
6,794,992 B1 9/2004 Rogers
6,809,275 B1 10/2004 Cheng et al.
6,834,430 B2 12/2004 Worrell
6,846,998 B2 1/2005 Hasumi et al.
6,888,076 B2 5/2005 Hetherington
6,896,403 B1 5/2005 Gau
6,909,378 B1 6/2005 Lambrechts et al.
6,914,551 B2 7/2005 Vidal
6,961,099 B2 11/2005 Takano et al.
6,963,039 B1 11/2005 Weng et al.
6,977,868 B2 12/2005 Brewer et al.
6,985,107 B2 1/2006 Anson
6,987,568 B2 1/2006 Dana
6,998,553 B2 2/2006 Hisamune et al.
7,016,263 B2 3/2006 Gueissaz et al.
7,034,237 B2 4/2006 Ferri et al.
7,081,905 B1 7/2006 Raghunath et al.
7,102,626 B2 9/2006 Denny, III
7,111,365 B1 9/2006 Howie, Jr.
7,119,289 B2 10/2006 Lacroix
7,135,673 B2 11/2006 Saint Clair
7,167,083 B2 1/2007 Giles
7,244,927 B2 7/2007 Huynh
7,255,473 B2 8/2007 Hiranuma et al.
7,265,336 B2 9/2007 Hataguchi et al.
7,274,303 B2 9/2007 Dresti et al.
7,285,738 B2 10/2007 Lavigne et al.
7,292,741 B2 11/2007 Ishiyama et al.
7,358,481 B2 4/2008 Yeoh et al.
7,369,308 B2 5/2008 Tsuruta et al.
7,371,745 B2 5/2008 Ebright et al.
7,385,874 B2 6/2008 Vuilleumier
7,404,667 B2 7/2008 Born et al.
7,465,917 B2 12/2008 Chin et al.
7,506,269 B2 3/2009 Lang et al.
7,520,664 B2 4/2009 Wai
7,528,824 B2 5/2009 Kong
7,545,367 B2 6/2009 Sunda et al.
7,591,582 B2 9/2009 Hiranuma et al.
7,593,755 B2 9/2009 Colando et al.
7,605,846 B2 10/2009 Watanabe
7,634,263 B2 12/2009 Louch et al.
7,646,677 B2 1/2010 Nakamura
7,682,070 B2 3/2010 Burton
7,708,457 B2 5/2010 Girardin
7,710,456 B2 5/2010 Koshiba et al.
7,732,724 B2 6/2010 Otani et al.
7,761,246 B2 7/2010 Matsui
7,763,819 B2 7/2010 Ieda et al.
7,772,507 B2 8/2010 Orr
7,778,115 B2 8/2010 Ruchonnet
7,781,726 B2 8/2010 Matsui et al.
RE41,637 E 9/2010 O'Hara et al.
7,791,597 B2 9/2010 Silverstein et al.
7,856,255 B2 12/2010 Tsuchiya et al.
7,858,583 B2 12/2010 Schmidt et al.
7,865,324 B2 1/2011 Lindberg
7,946,758 B2 5/2011 Mooring
8,063,892 B2 11/2011 Shahoian et al.
8,138,488 B2 3/2012 Grot
8,143,981 B2 3/2012 Washizu et al.
8,167,126 B2 5/2012 Stiehl
8,169,402 B2 5/2012 Shahoian et al.
8,188,989 B2 5/2012 Levin et al.
8,195,313 B1 6/2012 Fadell et al.
8,229,535 B2 7/2012 Mensinger et al.
8,248,815 B2 8/2012 Yang et al.
8,263,886 B2 9/2012 Lin et al.
8,263,889 B2 9/2012 Takahashi et al.
8,294,670 B2 10/2012 Griffin et al.
8,312,495 B2 11/2012 Vanderhoff
8,368,677 B2 2/2013 Yamamoto

(56) References Cited

U.S. PATENT DOCUMENTS 8,371,745 B2 2/2013 Manni
8,373,661 B2 2/2013 Lan et al.
8,410,971 B2 4/2013 Friedlander
8,432,368 B2 4/2013 Momeyer et al.
8,439,559 B2 5/2013 Luk et al.
8,441,450 B2 5/2013 Degner et al.
8,446,713 B2 5/2013 Lai
8,456,430 B2 6/2013 Oliver et al.
8,477,118 B2 7/2013 Lan et al.
8,493,190 B2 7/2013 Periquet et al.
8,508,511 B2 8/2013 Tanaka et al.
8,525,777 B2 9/2013 Stavely et al.
8,562,489 B2 10/2013 Burton et al.
8,568,313 B2 10/2013 Sadhu
8,576,044 B2 11/2013 Chapman
8,593,598 B2 11/2013 Chen et al.
8,607,662 B2 12/2013 Huang
8,614,881 B2 12/2013 Yoo
8,783,944 B2 2/2014 Doi
8,666,682 B2 3/2014 LaVigne et al.
8,704,787 B2 4/2014 Yamamoto
8,711,093 B2 4/2014 Ong et al.
8,724,087 B2 5/2014 Van De Kerkhof et al.
8,730,167 B2 5/2014 Ming et al.
8,743,088 B2 6/2014 Watanabe
8,804,993 B2 8/2014 Shukla et al.
8,816,962 B2 8/2014 Obermeyer et al.
8,824,245 B2 9/2014 Lau et al.
8,847,741 B2 9/2014 Birnbaum et al.
8,859,971 B2 10/2014 Weber
8,860,674 B2 10/2014 Lee et al.
8,863,219 B2 10/2014 Brown et al.
D717,679 S 11/2014 Anderssen
8,878,657 B2 11/2014 Periquet et al.
8,885,856 B2 11/2014 Sacha
8,895,911 B2 11/2014 Takahashi
8,905,631 B2 12/2014 Sakurazawa et al.
8,920,022 B2 12/2014 Ishida et al.
8,922,399 B2 12/2014 Bajaj et al.
8,928,452 B2 1/2015 Kim et al.
8,954,135 B2 2/2015 Yuen et al.
8,994,827 B2 3/2015 Mistry et al.
9,024,733 B2 5/2015 Wouters
9,028,134 B2 5/2015 Koshoji et al.
9,030,446 B2 5/2015 Mistry et al.
9,034,666 B2 5/2015 Vaganov et al.
9,041,663 B2 5/2015 Westerman
9,052,696 B2 6/2015 Breuillot et al.
9,086,717 B2 7/2015 Meerovitsch
9,086,738 B2 7/2015 Leung et al.
9,101,184 B2 8/2015 Wilson
9,105,413 B2 8/2015 Hiranuma et al.
9,123,483 B2 9/2015 Ferri et al.
9,141,087 B2 9/2015 Brown et al.
9,176,577 B2 11/2015 Jangaard et al.
9,176,598 B2 11/2015 Sweetser et al.
9,202,372 B2 12/2015 Reams et al.
9,213,409 B2 12/2015 Redelsheimer et al.
9,223,296 B2 12/2015 Yang et al.
9,241,635 B2 1/2016 Yuen et al.
9,244,438 B2 1/2016 Hoover et al.
9,256,209 B2 2/2016 Yang et al.
9,277,156 B2 3/2016 Bennett et al.
9,350,850 B2 5/2016 Pope et al.
9,386,932 B2 7/2016 Chatterjee et al.
9,426,275 B2 8/2016 Eim et al.
9,430,042 B2 8/2016 Levin
9,437,357 B2 9/2016 Furuki et al.
9,449,770 B2 9/2016 Sanford et al.
9,501,044 B2 11/2016 Jackson et al.
9,520,100 B2 12/2016 Houjou et al.
9,532,723 B2 1/2017 Kim
9,542,016 B2 1/2017 Armstrong-Muntner
9,545,541 B2 1/2017 Aragones et al.
9,552,023 B2 1/2017 Joo et al.
9,599,964 B2 3/2017 Gracia
9,607,505 B2 3/2017 Rothkopf et al.
9,620,312 B2 4/2017 Ely et al.
9,627,163 B2 4/2017 Ely
9,632,318 B2 4/2017 Goto et al.
9,638,587 B2 5/2017 Marquas et al.
9,659,482 B2 5/2017 Yang et al.
9,680,831 B2 6/2017 Jooste et al.
9,709,956 B1 7/2017 Ely et al.
9,753,436 B2 9/2017 Ely et al.
D800,172 S 10/2017 Akana
9,800,717 B2 10/2017 Ma et al.
9,836,025 B2 12/2017 Ely et al.
9,886,006 B2 2/2018 Ely et al.
9,891,651 B2 2/2018 Jackson et al.
9,946,297 B2 4/2018 Nazzaro et al.
9,952,558 B2 4/2018 Ely
9,971,305 B2 5/2018 Ely et al.
9,971,405 B2 5/2018 Holenarsipur et al.
10,001,817 B2 6/2018 Zambetti et al.
10,018,966 B2 * 7/2018 Ely ..... G04C 3/002
2003/0174590 A1 9/2003 Arikawa et al.
2004/0047244 A1 3/2004 Iino et al.
2004/0082414 A1 4/2004 Knox
2004/0130971 A1 7/2004 Ecoffet et al.
2004/0264301 A1 12/2004 Howard et al.
2005/0075558 A1 4/2005 Vecerina et al.
2006/0250377 A1 11/2006 Zadesky et al.
2007/0013775 A1 1/2007 Shin
2007/0050054 A1 3/2007 Sambandam Guruparan et al.
2007/0211042 A1 9/2007 Kim et al.
2007/0222756 A1 9/2007 Wu et al.
2007/0229671 A1 10/2007 Takeshita et al.
2007/0247421 A1 10/2007 Orsley et al.
2008/0130914 A1 6/2008 Cho
2009/0051649 A1 2/2009 Rondel
2009/0073119 A1 3/2009 Le et al.
2009/0122656 A1 5/2009 Bonnet et al.
2009/0146975 A1 6/2009 Chang
2009/0152452 A1 6/2009 Lee et al.
2009/0217207 A1 8/2009 Kagermeier et al.
2009/0285443 A1 11/2009 Camp et al.
2009/0312051 A1 12/2009 Hansson et al.
2010/0033430 A1 2/2010 Kakutani et al.
2010/0053468 A1 3/2010 Havrill
2010/0081375 A1 4/2010 Rosenblatt et al.
2010/0149099 A1 6/2010 Elias
2011/0007468 A1 1/2011 Burton et al.
2011/0090148 A1 4/2011 Li et al.
2011/0158057 A1 6/2011 Brewer et al.
2011/0242064 A1 10/2011 Ono et al.
2012/0067711 A1 3/2012 Yang
2012/0068857 A1 3/2012 Rothkopf et al.
2012/0075082 A1 3/2012 Rothkopf et al.
2012/0112859 A1 5/2012 Park et al.
2012/0113044 A1 5/2012 Strazisar et al.
2012/0206248 A1 8/2012 Biggs
2012/0272784 A1 11/2012 Bailey et al.
2013/0021880 A1 * 1/2013 Doi ..... G04B 3/041
368/206
2013/0037396 A1 2/2013 Yu
2013/0087443 A1 4/2013 Kikuchi
2013/0191220 A1 7/2013 Dent et al.
2013/0261405 A1 10/2013 Lee et al.
2013/0335196 A1 12/2013 Zhang et al.
2014/0071098 A1 3/2014 You
2014/0132516 A1 5/2014 Tsai et al.
2014/0197936 A1 7/2014 Biggs et al.
2014/0327630 A1 11/2014 Burr et al.
2014/0340318 A1 11/2014 Stringer et al.
2014/0347289 A1 11/2014 Suh et al.
2015/0023142 A1 * 1/2015 Breuillot ..... G04B 37/103
368/290
2015/0098309 A1 4/2015 Adams et al.
2015/0124415 A1 5/2015 Goyal et al.
2015/0186609 A1 7/2015 Utter, II
2015/0221460 A1 8/2015 Teplitxky et al.
2015/0227217 A1 8/2015 Fukumoto
2015/0366098 A1 12/2015 Lapetina et al.

(56) References Cited

U.S. PATENT DOCUMENTS

| | | | |
|---|---|---|---|
| 2016/0018846 | A1 | 1/2016 | Zenoff |
| 2016/0054813 | A1 | 2/2016 | Shediwy et al. |
| 2016/0058375 | A1 | 3/2016 | Rothkopf et al. |
| 2016/0061636 | A1 | 3/2016 | Gowreesunker et al. |
| 2016/0062623 | A1 | 3/2016 | Howard et al. |
| 2016/0069713 | A1 | 3/2016 | Ruh et al. |
| 2016/0103985 | A1 | 4/2016 | Shim et al. |
| 2016/0109861 | A1 | 4/2016 | Kim et al. |
| 2016/0116306 | A1 | 4/2016 | Ferri et al. |
| 2016/0147432 | A1 | 5/2016 | Shi et al. |
| 2016/0168178 | A1 | 6/2016 | Hoover et al. |
| 2016/0170598 | A1 | 6/2016 | Zambetti et al. |
| 2016/0170608 | A1 | 6/2016 | Zambetti et al. |
| 2016/0170624 | A1 | 6/2016 | Zambetti et al. |
| 2016/0253487 | A1 | 9/2016 | Sarkar et al. |
| 2016/0258784 | A1 | 9/2016 | Boonsom et al. |
| 2016/0306437 | A1 | 10/2016 | Zhang et al. |
| 2016/0306446 | A1 | 10/2016 | Chung et al. |
| 2016/0313703 | A1 | 10/2016 | Ely et al. |
| 2016/0320583 | A1 | 11/2016 | Hall, Jr. |
| 2016/0327911 | A1 | 11/2016 | Eim et al. |
| 2016/0378069 | A1 | 12/2016 | Rothkopf et al. |
| 2016/0378070 | A1 | 12/2016 | Rothkopf et al. |
| 2016/0378071 | A1 | 12/2016 | Rothkopf et al. |
| 2017/0003655 | A1 | 1/2017 | Ely |
| 2017/0010751 | A1 | 1/2017 | Shedletsky |
| 2017/0011210 | A1 | 1/2017 | Cheong et al. |
| 2017/0031449 | A1 | 2/2017 | Karsten et al. |
| 2017/0045958 | A1 | 2/2017 | Battlogg et al. |
| 2017/0061863 | A1 | 3/2017 | Eguchi |
| 2017/0069443 | A1 | 3/2017 | Wang et al. |
| 2017/0069444 | A1 | 3/2017 | Wang et al. |
| 2017/0069447 | A1 | 3/2017 | Wang et al. |
| 2017/0104902 | A1 | 4/2017 | Kim et al. |
| 2017/0139489 | A1* | 5/2017 | Chen ..... G06F 3/0312 |
| 2017/0216668 | A1 | 8/2017 | Burton et al. |
| 2017/0238138 | A1 | 8/2017 | Aminzade |
| 2017/0251561 | A1 | 8/2017 | Fleck et al. |
| 2017/0269715 | A1* | 9/2017 | Kim ..... G06F 3/0362 |
| 2017/0285404 | A1 | 10/2017 | Kubota et al. |
| 2017/0301314 | A1 | 10/2017 | Kim et al. |
| 2017/0307414 | A1 | 10/2017 | Ferri et al. |
| 2017/0331869 | A1 | 11/2017 | Bendahan et al. |
| 2017/0357465 | A1 | 12/2017 | Dzeryn et al. |
| 2018/0018026 | A1 | 1/2018 | Bushnell et al. |
| 2018/0024683 | A1 | 1/2018 | Ely et al. |
| 2018/0136613 | A1 | 5/2018 | Ely et al. |
| 2018/0136686 | A1 | 5/2018 | Jackson et al. |
| 2018/0239306 | A1 | 8/2018 | Ely |
| 2018/0246469 | A1 | 8/2018 | Ely et al. |
| 2018/0307363 | A1 | 10/2018 | Ely et al. |

FOREIGN PATENT DOCUMENTS

| | | |
|---|---|---|
| CN | 1445627 | 10/2003 |
| CN | 1504843 | 6/2004 |
| CN | 1624427 | 6/2005 |
| CN | 1792295 | 6/2006 |
| CN | 101201587 | 6/2008 |
| CN | 201081979 | 7/2008 |
| CN | 101750958 | 6/2010 |
| CN | 101923314 | 12/2010 |
| CN | 202008579 | 10/2011 |
| CN | 102890443 | 1/2013 |
| CN | 202710937 | 1/2013 |
| CN | 103191557 | 7/2013 |
| CN | 103253067 | 8/2013 |
| CN | 103645804 | 3/2014 |
| CN | 203564224 | 4/2014 |
| CN | 103852090 | 6/2014 |
| CN | 203630524 | 6/2014 |
| CN | 103956006 | 7/2014 |
| CN | 203693601 | 7/2014 |
| CN | 203732900 | 7/2014 |
| CN | 103995456 | 8/2014 |
| CN | 203941395 | 11/2014 |
| CN | 104777987 | 4/2015 |
| CN | 104880937 | 9/2015 |
| CN | 204650147 | 9/2015 |
| CN | 105096979 | 11/2015 |
| CN | 105547146 | 5/2016 |
| DE | 3706194 | 9/1988 |
| DE | 102008023651 | 11/2009 |
| DE | 102016215087 | 3/2017 |
| EP | 0556155 | 8/1993 |
| EP | 1345095 | 9/2003 |
| EP | 1669724 | 6/2006 |
| EP | 1832969 | 9/2007 |
| EP | 2375295 | 10/2011 |
| EP | 2720129 | 4/2014 |
| FR | 2030093 | 10/1970 |
| FR | 2801402 | 5/2001 |
| GB | 2433211 | 6/2007 |
| JP | S5708582 | 1/1982 |
| JP | S5734457 | 2/1982 |
| JP | H02285214 | 11/1990 |
| JP | H04093719 | 3/1992 |
| JP | H05203465 | 8/1993 |
| JP | H05312595 | 11/1993 |
| JP | H06347293 | 12/1994 |
| JP | H10161811 | 6/1998 |
| JP | H11121210 | 4/1999 |
| JP | H11191508 | 7/1999 |
| JP | 2000337892 | 12/2000 |
| JP | 2001084934 | 3/2001 |
| JP | 2001202178 | 7/2001 |
| JP | 2003050668 | 2/2003 |
| JP | 2003151410 | 5/2003 |
| JP | 2003331693 | 11/2003 |
| JP | 2004184396 | 7/2004 |
| JP | 2005017011 | 1/2005 |
| JP | 2005063200 | 3/2005 |
| JP | 2006164275 | 6/2006 |
| JP | 2007248176 | 9/2007 |
| JP | 2007311153 | 11/2007 |
| JP | 2008053980 | 3/2008 |
| JP | 2008122124 | 5/2008 |
| JP | 2008122377 | 5/2008 |
| JP | 2008170436 | 7/2008 |
| JP | 2008235226 | 10/2008 |
| JP | 2009070657 | 4/2009 |
| JP | 2010032545 | 2/2010 |
| JP | 2010165001 | 7/2010 |
| JP | 2010186572 | 8/2010 |
| JP | 2010243344 | 10/2010 |
| JP | 2010244797 | 10/2010 |
| JP | 2011165468 | 8/2011 |
| JP | 2013057516 | 3/2013 |
| JP | 2013079961 | 5/2013 |
| JP | 2014174031 | 9/2014 |
| KR | 20010030477 | 4/2001 |
| KR | 20070014247 | 2/2007 |
| KR | 20080045397 | 5/2008 |
| KR | 20110011393 | 2/2011 |
| NL | 1040225 | 11/2014 |
| TW | 200633681 | 10/2006 |
| WO | WO2001/022038 | 3/2001 |
| WO | WO2001/069567 | 9/2001 |
| WO | WO2010/058376 | 5/2010 |
| WO | WO2012/083380 | 6/2012 |
| WO | WO2012/094805 | 7/2012 |
| WO | WO2014/018118 | 1/2014 |
| WO | WO2015/147756 | 10/2015 |
| WO | WO2016/104922 | 6/2016 |
| WO | WO2016/155761 | 10/2016 |

OTHER PUBLICATIONS

Author Unknown, "Fossil Q ups smartwatch game with handsome design and build," Business Mirror, Makati City, Philippines, 3 pages, Dec. 20, 2016.

Author Unknown, "How Vesag Helps Kids Women and Visitors," http://www.sooperarticles.com/health-fitness-articles/children-health-

(56) References Cited

OTHER PUBLICATIONS articles/how-vesag-helps-kids-women-visitors-218542.html, 2 pages, at least as early as May 20, 2015.
Author Unknown, "m Health," http://mhealth.vesag.com/?m=201012, 7 pages, Dec. 23, 2010.
Author Unknown, "mHealth Summit 2010," http://www.virtualpressoffice.com/eventsSubmenu.do?page=exhibitorPage&showId=1551&companyId=5394, 5 pages, Nov. 18, 2010.
Author Unknown, "MyKronoz ZeTime: World's Most Funded Hybrid Smartwatch Raised over $3M on Kickstarter, Running until Apr. 27," Business Wire, New York, New York, 3 pages, Apr. 21, 2017.
Author Unknown, "RedEye mini Plug-in Universal Remote Adapter for iPhone, iPod touch and iPad," Amazon.com, 4 pages, date unknown.
Author Unknown, "Re iPhone Universal Remote Control—Infrared Remote Control Accessory for iPhone and iPod touch," http://www.amazon.com/iPhone-Universal-Remote-Control-Accessory/dp/tech-data/B0038Z4 . . . , 2 pages, at least as early as Jul. 15, 2010.
Author Unknown, "Vesag Wrist Watch for Dementia Care from VYZIN," http://vyasa-kaaranam-ketkadey.blogspot.com/2011/03/vesag-wrist-watch-for-dementia-care.html, 2 pages, Mar. 31, 2011.
Author Unknown, "Vyzin Electronics Private Limited launches Vesag Watch," http://www.virtualpressoffice.com/showJointPage.do?page=jp&showId=1544, 5 pages, Jan. 6, 2011.
Author Unknown, "Vyzin Unveiled Personal Emergency Response System (PERS) with Remote Health Monitoring That Can Be Used for Entire Family," http://www.24-7pressrelease.com/press-release/vyzin-unveiled-personal-emergency-response-system-pers-with-remote-health-monitoring-that-can-be-used-for-entire-family-219317.php, 2 pages, Jun. 17, 2011.
Author Unknown, "DeskThorityNet, Optical Switch Keyboards," http://deskthority.net/keyboards-f2/optical-switch-keyboards-t1474.html, 22 pages, Jul. 11, 2015.
Epstein et al., "Economical, High-Performance Optical Encoders," Hewlett-Packard Journal, pp. 99-106, Oct. 1988. [text only version].
GreyB, "Google Watch: Convert your arm into a keyboard," http://www.whatafuture.com/2014/02/28/google-smartwatch/#sthash.Yk35cDXK.dpbs, 3 pages, Feb. 28, 2014.
IBM, "Additional Functionality Added to Cell Phone via "Learning" Function Button," www.ip.com, 2 pages, Feb. 21, 2007.
Kim, Joseph, "2010 mHealth Summit Emerges as Major One-Stop U.S. Venue for Mobile Health," http://www.medicineandtechnology.com/2010/08/2010-mhealth-summit-emerges-as-major.html, 3 pages, Aug. 26, 2010.
Krishnan et al., "A Miniature Surface Mount Reflective Optical Shaft Encoder," Hewlett-Packard Journal, Article 8, pp. 1-6, Dec. 1996.
Rick, "How VESAG Helps Health Conscious Citizens," http://sensetekgroup.com/2010/11/29/wireless-health-monitoring-system/, 2 pages, Nov. 29, 2010.
Sadhu, Rajendra, "How VESAG Helps People Who Want to 'Be There'?," http://ezinearticles.com/?How-Vesag-Helps-People-Who-Want-to-Be-There?&id-5423873, 1 page, Nov. 22, 2010.
Sadhu, Rajendra, "Mobile Innovation Helps Dementia and Alzheimer's Patients," http://www.itnewsafrica.com/2010/11/mobile-innovation-helps-dementia-andalzheimer%E2%80%99s-patients/, 3 pages, Nov. 22, 2010.
Sherr, Sol, "Input Devices," p. 55, Mar. 1988.
Tran et al., "Universal Programmable Remote Control/Telephone," www.ip.com, 2 pages, May 1, 1992.

* cited by examiner

COVER MEMBER FOR AN INPUT MECHANISM OF AN ELECTRONIC DEVICE

CROSS-REFERENCE TO RELATED APPLICATIONS

This application is a continuation patent application of U.S. patent application Ser. No. 15/092,584, filed Apr. 6, 2016 and titled "Cover Member for an Input Mechanism of an Electronic Device," which is a nonprovisional patent application of and claims benefit to U.S. Provisional Patent Application No. 62/152,282, filed Apr. 24, 2015 and titled "Cap for Input Mechanism," the disclosures of which are hereby incorporated herein by reference in their entireties.

FIELD

This disclosure relates generally to attachment mechanisms for coupling a cover member to an input mechanism, such as a rotating input mechanism for an electronic device.

BACKGROUND

Many types of electronic or other devices utilize input devices to receive user input. For example, both electrical and mechanical watches may have crowns that allow a user to set the time, date, or operate other functions of the device. In the case of a smartwatch, a crown may be operable to manipulate a user interface, change modes of the device, or provide other inputs. Crowns may have many different designs, features, and appearances for functional and/or aesthetic purposes.

SUMMARY

Some example embodiments are directed to a watch crown assembly that includes a body configured to receive rotary input and defines a recess and a retention feature. The watch crown further comprises a ceramic member positioned at least partially in the recess and a mounting arm attached to the ceramic member and engaged with the retention feature of the body, thereby retaining the ceramic member to the body.

In some embodiments, the retention feature is an opening in the body, and the mounting arm extends at least partially into the opening. The mounting arm may be welded to the body. In some embodiments, the ceramic member defines a hole, and the mounting arm is secured in the hole using an interference fit. In some embodiments, the mounting arm is formed from a metal material and is fused to the ceramic member. In some embodiments, the mounting arm comprises a catch member, the retention feature comprises an undercut, and the catch member engages the undercut to retain the ceramic member to the body. In some embodiments, the ceramic member comprises zirconia and the mounting arm comprises tungsten.

In some embodiments, the body is further configured to receive a translational input, and the input assembly is incorporated in a wearable electronic device. The wearable electronic device comprises a housing, a display positioned within the housing, and a processor. The processor is configured to present a user interface on the display, perform a first user-interface action in response to the rotary input, and perform a second user-interface action different from the first user-interface action in response to the translational input. In some embodiments, the first user-interface action comprises moving a cursor on the display, and the second user-interface action comprises displaying selected content on the display.

Some example embodiments are directed to a watch crown assembly including a body defining an undercut and a zirconia member coupled to the body via a retention clip. The retention clip may be attached to the zirconia member and is engaged with the undercut. In some embodiments, the zirconia member comprises a first surface defining an exterior surface of the watch crown assembly and a second surface opposite the first surface and having a hole formed therein. A first end of the retention clip may be fixed in the hole, a second end of the retention clip may comprise a catch member, and the catch member may engage the undercut, thereby retaining the zirconia member to the body.

In some embodiments, the retention clip comprises a mounting plate and an arm extending from the mounting plate and comprising a catch member. The mounting plate may be coupled to the zirconia member, and the catch member may engage the undercut, thereby retaining the zirconia member to the body. The arm and the mounting plate may be a unitary structure.

In some embodiments, the retention clip is a first retention clip, the undercut is a first undercut, the body further defines a second undercut, and the watch crown assembly further comprises a second retention clip engaged with the second undercut. In some embodiments, the watch crown assembly further comprises a retention ring, wherein an inner surface of the retention ring engages a peripheral edge of the zirconia member, thereby retaining the retention ring to the zirconia member. The retention ring may be integrally formed with the retention clip. In some embodiments, the watch crown assembly further comprises a biasing member between the zirconia member and the body and forcing the retention clip into engagement with the undercut.

Some example embodiments are directed to a wearable electronic device that includes a housing and an input assembly coupled to the housing. The input assembly may be configured to rotate relative to the housing to provide an input to the wearable electronic device. The input assembly may comprise an actuation member having a portion extending into an interior volume of the housing, a cover member coupled to the actuation member and forming a portion of an exterior surface of the input assembly, and a protruding member attached to the cover member and engaged with a retention feature of the actuation member, thereby retaining the cover member to the actuation member.

In some embodiments, the input assembly is configured to receive a rotary input and a translational input, and the wearable electronic device further comprises a display positioned within the housing and a processor. The processor is configured to present a user interface on the display, perform a first user-interface action in response to the rotary input, and perform a second user-interface action different from the first user-interface action in response to the translational input. In some embodiments, the first user-interface action comprises moving a cursor on the display, and the second user-interface action comprises displaying selected content on the display.

In some embodiments, the actuation member defines a recess and comprises a hole extending through a portion of the actuation member that defines the recess. A first end of the protruding member may be attached to the cover member, and the protruding member may extend into the hole and is welded to the actuation member at a second end of the protruding member opposite the first end.

In some embodiments, the actuation member comprises a sidewall and a channel formed into the sidewall, and the protruding member comprises a catch member that extends into and engages the channel to retain the cover member to the actuation member. In some embodiments, the input assembly comprises a biasing member positioned between the cover member and the actuation member that biases the cover member away from the actuation member, thereby forcing the catch member against a wall of the channel. In some embodiments, the cover member is formed from zirconia and has a thickness less than or equal to about 500 microns. In some embodiments, the exterior surface of the cover member is substantially flush with a portion of the actuation member that surrounds the cover member.

BRIEF DESCRIPTION OF THE DRAWINGS

The disclosure will be readily understood by the following detailed description in conjunction with the accompanying drawings, wherein like reference numerals designate like structural elements.

DETAILED DESCRIPTION

Reference will now be made in detail to representative embodiments illustrated in the accompanying drawings. It should be understood that the following description is not intended to limit the embodiments to one preferred embodiment. To the contrary, it is intended to cover alternatives, modifications, and equivalents as can be included within the spirit and scope of the described embodiments as defined by the appended claims.

The present disclosure details systems and apparatuses for coupling a cover or cap, such as a ceramic component, to an input assembly, such as a watch crown. For example, a watch crown may include a cover disposed in a recess in an end of the crown. The cover may be the same or a different material as the crown, but because the cover is a distinct component, it should be coupled to the crown with enough strength to keep the components securely attached during normal use of the watch.

In some cases, attaching a cover or a cap to a watch crown (or other input assembly) may present added challenges due to the sizes and materials of the components being coupled. For example, covers that are set into the end of the crown may be relatively thin, and thus relatively fragile. Accordingly, attachment mechanisms that occupy less space may allow thicker and stronger covers to be used.

Moreover, for many cover materials, it may be difficult to form retention features directly in the cover. For example, it may be difficult to form posts, clips, or undercuts in covers formed from sapphire, glass, zirconia, or other ceramic materials. And even if such features and/or structures were formed from such materials, the resulting features may not be suitable for use as a retention feature. For example, some cover materials may be too brittle and/or fragile to be used for retention features, or they may be difficult to bond to other materials (e.g., by welding).

Various techniques are described herein for coupling a cover to an input assembly. For example, a cover may be coupled to an input assembly via a post that is retained in an opening (e.g., a blind hole) in the cover and is welded or otherwise bonded to a body of the input assembly. As another example, a cover may be coupled to an input assembly via a retention clip that is coupled to the cover and engaged with an undercut in the body of the input assembly. Additional embodiments and details are described herein.

Figure 1A:
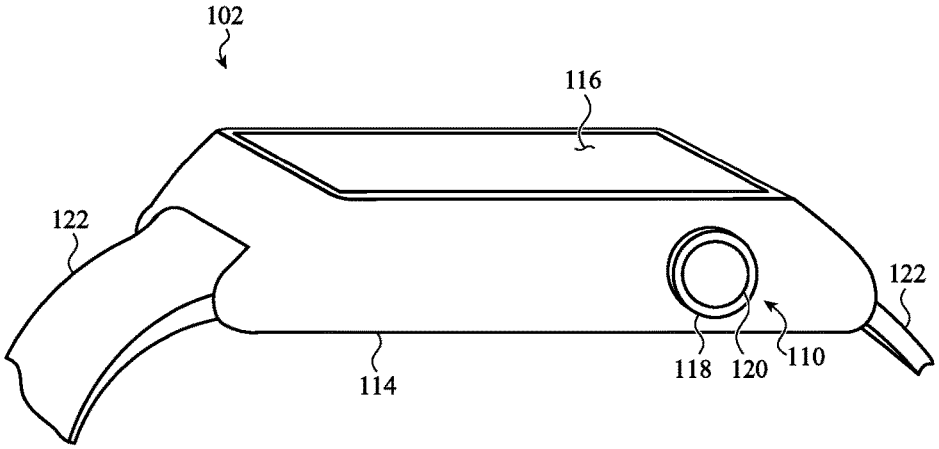
FIGS. 1A-1B show an example electronic device incorporating an input assembly.
Figure 1B:
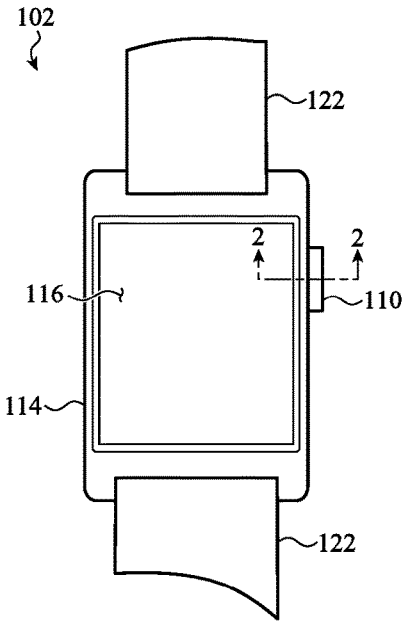

FIGS. 1A and 1B are different views of a device 102. The device 102 includes a housing 114, a display 116, and an input assembly 110. The input assembly 110 may be (or may be a component of) an input mechanism for the device 102. Where the device 102 is a wearable device, such as a "smartwatch," the input assembly 110 may be or may be similar to a watch crown assembly, and may provide functions similar to a watch crown (as well as other functions, as described herein).

The input assembly 110 includes a body 118 and a cover member 120 (which may also be referred to as a cap). A user may manipulate the body 118 with his or her fingers in order to rotate and/or translate the input assembly 110 to provide an input to the device 102, as described herein.

The input assembly 110 may be configured to receive multiple kinds of physical inputs, including translational inputs (e.g., axial inputs corresponding to a push or pull relative to the housing 114) and/or rotational or rotary inputs from a user. In particular, the input assembly 110, or a portion thereof, may be accessible to and capable of manipulation by a user. The input assembly 110 may include an interface surface, such as an outer rim or edge of the body 118, that a user may grasp or otherwise interact with to push, pull, or rotate the input assembly 110. The interface surface may have a shape or texture that facilitates rotary input from a user, such as a knurled or roughened surface. Alternatively, the interface surface may be unfeatured and/or smooth (e.g., polished).

The input assembly 110 may include or interact with a sensor (not shown) that detects translational and/or rotational inputs to the input assembly 110. These or other physical inputs may be used to control the device 102, such as to manipulate a user interface displayed on the display 116, to enable or disable a function of the device 102, set the time or other parameter of the device, or the like. Moreover, the input assembly 110 may receive different types of physical inputs and may perform different types of actions based on the type of input received. For example, the device 102 may be configured to display a user interface on the display 116. In response to receiving a first type of physical input via the input assembly 110, such as a rotary input, the device 102 may perform a first user-interface action, such as moving a cursor on the display, scrolling through text or images, zooming in or out on displayed text or images, changing a selected element of a group of selectable elements, changing a value of a parameter (e.g., a time or date), or the like. In response to receiving a second type of physical input via the input assembly 110, such as a translational input (e.g., a push), the device 102 may perform a second user-interface action that is different than the first user-interface action. For example, the device 102 may change what is displayed on the display 116, display selected content on the display 116, or register a selection of a value or a parameter (e.g., a time, a date, an object to be viewed or saved, or the like).

As noted above, the device 102 may be a smartwatch having diverse functionality. Because the input assembly 110 can receive different types of physical inputs, it may provide an intuitive and efficient way for a user to interact with the device 102. For example, when the display 116 is displaying a list of selectable objects, a user can rotate the input assembly 110 to scroll through the list until a desired object is highlighted or otherwise indicated to be selectable. Then, the user can translate (e.g., press) the input assembly 110 to select the highlighted element, which will result in presentation or display of the highlighted element. For example, the display 116 will cease displaying the list and instead display the contents of the selected object. Other user interface and device functions may also be controlled and/or selected by the various physical inputs receivable by the input assembly 110.

The cover member 120 may be coupled to the body 118 such that a surface of the cover member 120 is substantially flush with a surface of the body 118, thus forming a substantially continuous exterior surface of the input assembly 110. The substantially continuous exterior surface may reduce the tendency of the input assembly 110 to catch or snag on other objects, and may provide a smooth tactile feel to the input assembly 110. Also, because the cover member 120 does not extend beyond the surface of the body 118, the cover member 120 may be less likely to be chipped or accidentally pried out of the body 118 during everyday use.

The cover member 120 may be coupled to the body 118 in various ways, as described herein. For example, a post may be attached to the cover member 120, and the cover member 120 may be assembled with the body 118 such that the post is positioned in a hole or an opening in the body 118 and welded to the body 118. Other mechanisms for coupling the cover member 120 to the body 118 are discussed herein, including retention clips and retention rings.

As shown in the figures, the cover member 120 is a disk-shaped component, though other shapes and configurations are also possible, such as square, rectangular, oval, or the like. Moreover, the cover member 120 depicted in the instant figures is merely one example of a component, part, or member that may be set into or otherwise attached to an end of an input assembly 110. For example, the cover member 120 may be a sheet, a disk, a cover, a plate, a lens, a window, a jewel, a dome, a stone, or the like.

As shown, the device 102 is a wearable electronic device (e.g., a smartwatch). However, the device 102 may be any appropriate device, including an electronic computing device (e.g., a laptop, desktop, or tablet computer), a mobile communications device (e.g., a "smartphone"), a health monitoring device, a timekeeping device, a stopwatch, a mechanical or electromechanical watch, or the like. The device 102 may also include a band 122 coupled thereto for attaching the device 102 to a user or to another object.

Figure 2:
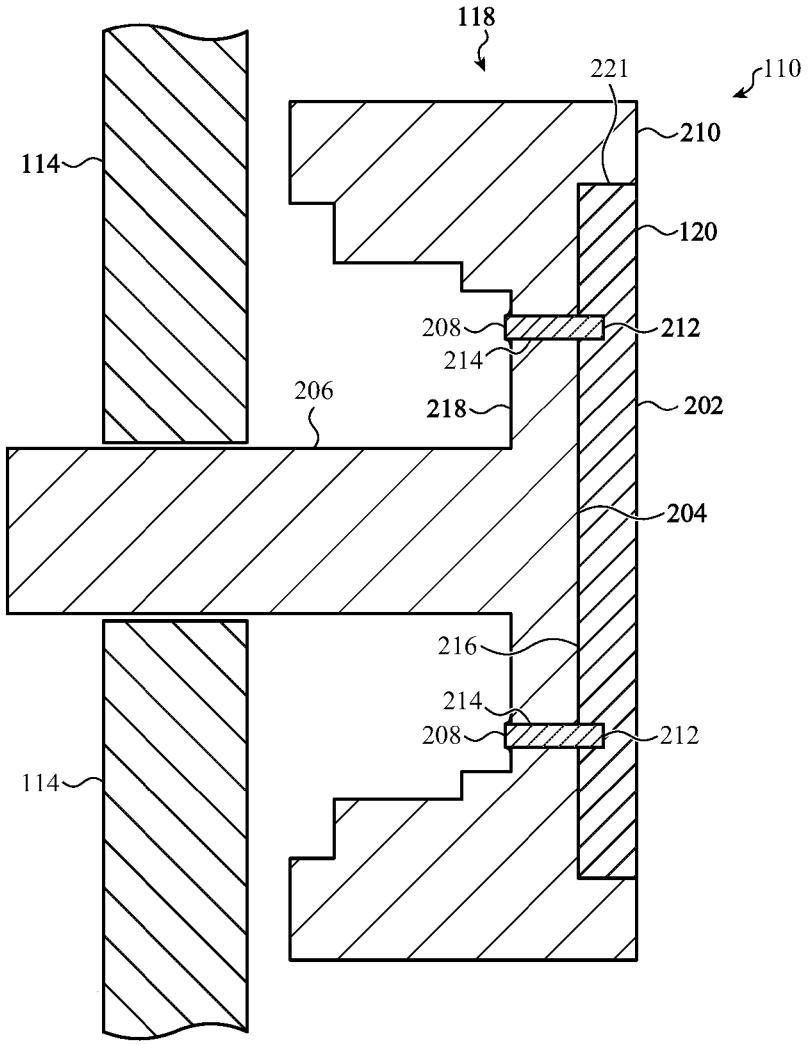
FIG. 2 shows a cross-sectional view of an example input assembly taken along section 2-2 of FIG. 1B.

FIG. 2 shows a cross-sectional view of the input assembly 110 along section 2-2 of FIG. 1B, showing an example technique for attaching the cover member 120 to the body 118. The input assembly 110 may also be referred to as a watch crown or a watch crown assembly. As shown, the cover member 120 is mounted to the body 118 to form an exterior surface of the input assembly 110. Arms 208, described herein, extend into openings in both the cover member 120 and the body 118 to couple or retain the cover member 120 to the body 118.

The body 118 defines a recess 221 in which the cover member 120 is at least partially disposed. The body 118 (or portions thereof) may be formed from a metal material (e.g., steel, titanium, gold, silver, tungsten, aluminum, amorphous metal alloy, nickel, metal alloys, and the like), ceramic, polymer, or any other appropriate material. In FIG. 2, the body 118 is a single, monolithic component. In other embodiments, such as those shown in FIGS. 4A, 6, and 7A, the body 118 includes multiple components that are coupled together.

The cover member 120 is positioned at least partially in the recess 221, and is at least partially surrounded by a frame 210. The frame 210 defines a perimeter of the recess 221 and may be a portion of the body 118. For example, the frame 210 may be integrally formed with the body 118.

The cover member 120 comprises an outer surface 202 (e.g., a first surface) that faces away from the device 102 and defines at least a portion of an exterior surface of the input assembly 110. The cover member 120 also comprises an inner surface 204 (e.g., a second surface) that is opposite the outer surface 202 and that faces towards the input assembly 110 and/or the device 102. The cover member 120 may be formed from zirconia or from other appropriate materials, such as sapphire, glass, ceramic, polymer, a metal material (e.g., steel, titanium, gold, silver, tungsten, aluminum, amorphous metal alloy, or nickel), or the like. Where a cover member is formed from ceramic, it may be referred to as a ceramic member. Similarly, where a cover member is formed from zirconia, it may be referred to as a zirconia member. The cover member 120 may be any appropriate thickness, such as less than or equal to about 500 microns. In some cases, the cover member 120 is about 100 microns thick.

The cover member 120 is coupled or retained to the body 118. In particular, the input assembly 110 may include protruding members, such as mounting arms 208, that extend away or protrude from the inner surface 204 of the cover member 120 and are coupled to the body 118 to retain the cover member 120 to the body 118. In FIG. 2, the mounting arms 208 are posts (e.g., square, rectangular, cylindrical, or other shaped posts). Other protruding members, such as retention clips, may be used instead of or in addition to the mounting arms 208. Embodiments that use retention clips are described herein with respect to FIGS. 4A-10C.

The mounting arms 208 may be attached to the cover member 120 in any appropriate manner. As shown in FIG. 2, ends (e.g., first ends) of the mounting arms 208 are disposed in holes 212 (which may be blind holes, as shown) formed in the inner surface 204 of the cover member 120. The holes 212 may be any appropriate size or shape to accommodate the mounting arms 208, including circular, arcuate, rectangular, square, and so on.

The mounting arms 208 may be secured in the holes 212 using an interference fit, sintering, adhesive, or any other appropriate technique. For example, to produce an interference fit, a mounting arm 208 may be cooled so as to reduce the size of the mounting arm 208 in at least one direction (e.g., to reduce the diameter of a cylindrical mounting arm). The cooled mounting arm 208 is introduced into a hole 212 and allowed to return to ambient temperature, causing the mounting arm 208 to expand to a larger size and thus forcing the walls of the mounting arm 208 against the walls of the hole 212. Alternatively, the cover member 120 may be heated to expand the size of the holes 212 to allow the mounting arms 208 to be introduced therein. Once the cover member 120 is cooled, the holes 212 will shrink to a smaller size, thus forcing the walls of the holes 212 against the walls of the mounting arms 208.

As another example, a mounting arm 208 may be inserted into a hole 212 and heated until the mounting arm 208 and the cover member 120 fuse together (e.g., a sintering process). Where the mounting arm 208 and the cover member 120 are sintered, the materials of these components may be selected for their ability to fuse to one another at a temperature that is not detrimental to either material. For example, in some cases, the mounting arm 208 is formed from tungsten, and the cover member 120 is formed from zirconia. Tungsten may be selected because it fuses to zirconia during sintering, and because tungsten can be welded to the body 118, as described below. However, the mounting arm 208 may be formed from any material that can be suitably coupled with both the cover member 120 and the body 118, such as metal materials (e.g., steel, titanium, aluminum, amorphous metal alloys, metal alloys), ceramics, or polymers.

The cover member 120 is coupled to the body 118 via the mounting arms 208. In particular, the body 118 includes retention features, such as openings 214, which may be holes extending from a mounting surface 216 to a back surface 218 of the body 118. Ends of the mounting arms 208 (e.g., second ends) extend through the openings 214 toward the back surface 218, where they may extend beyond the back surface 218, be flush with the back surface 218, or be recessed from the back surface 218. The distal ends of the mounting arms 208 (e.g., the second ends of the mounting arms that extend into the openings and are proximate the back surface 218) may be welded to the body 118 at or near the back surface 218, thereby coupling the mounting arms 208 (and thereby the cover member 120) to the body 118. In other embodiments, the mounting arms 208 may be staked to the body 118 or secured to the body 118 using an interference fit. Where an interference fit is used, the mounting arms 208 may be cooled prior to insertion into the openings 214. Once inserted, the mounting arms 208 may be allowed to return to ambient temperature, causing the mounting arms 208 to expand to a larger size and thus forcing the walls of the mounting arms 208 against the walls of the openings 214. Where an interference fit is used to couple the mounting arms 208 to both the cover member 120 and to the body 118, the mounting arms 208 may first be cooled, and then assembled with both the cover member 120 and the body 118 so that the expansion of the mounting arms 208 produces an interference fit with the openings in both the cover member 120 and the body 118 substantially simultaneously.

The inner surface 204 of the cover member 120 may be directly mounted to the mounting surface 216 of the body 118. For example, at least part of the inner surface 204 of the cover member 120 may be in direct contact with the body 118 without any interstitial components or layers, such as adhesive layers. By avoiding interstitial layers, more space is available for the cover member 120, thus allowing a thicker cover member 120 to be used. The thicker cover member 120 may be tougher and more resistant to breaking than a thinner cover member, thus providing an overall more durable input assembly 110.

In FIG. 2, the cover member 120 is disposed in the recess 221 such that a surface of the cover member 120 is substantially flush with a surface of the frame 210, thus forming a substantially continuous exterior surface of the input assembly 110. In other embodiments, the cover member 120 may be proud of or recessed from the frame 210. In such cases, the edges of the frame 210 and the cover member 120 that are adjacent each other may still form a substantially continuous surface. For example, the frame 210 and the cover member 120 may have curved surfaces that together define a substantially continuous convex or "domed" surface of the input assembly 110.

A shaft 206, which may be a portion of the body 118, may extend into an interior volume of the housing 114, and may be coupled to the housing 114, and/or any other portion of the device 102. For example, the shaft 206 (and/or other parts of the input assembly 110) may be supported by one or more bearings, bushings, or other mechanisms (not shown) that couple the input assembly 110 to the housing 114 while also allowing the input assembly 110 to translate and/or rotate with respect to the housing 114. The shaft 206 and the body 118 may be a single monolithic component, or they may be separate components coupled together. The body 118, which includes or is coupled to the shaft 206, may be referred to as an actuation member.

The input assembly 110 may also include or be coupled to other components that are not shown in the figures, such as support structures, seals, optical encoders, switches, and the like. Such components are omitted from the figures for clarity.

Figure 3A:
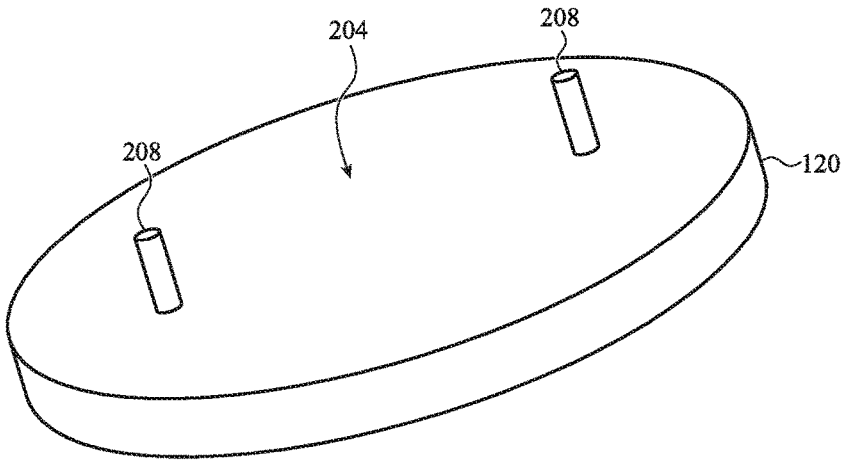
FIGS. 3A-3B show example cover members of the input assembly of FIG. 2.
Figure 3B:
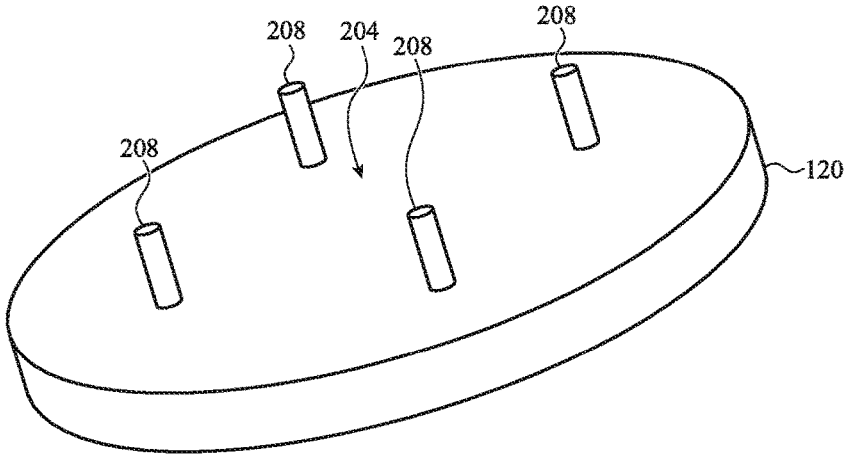

FIG. 3A shows an example arrangement of the mounting arms 208 on the cover member 120. In particular, two mounting arms 208 are attached to the cover member 120 and protrude from the inner surface 204 of the cover member 120. FIG. 3B is another example arrangement of mounting arms, including four mounting arms 208 arranged such that each mounting arm 208 is located at a vertex of a hypothetical or imaginary square. As shown, the mounting arms 208 are substantially cylindrical posts, though, as noted above, this is merely one example shape for the mounting arms 208. Moreover, the mounting arms 208 may be positioned on the cover member 120 in locations other than those shown in FIGS. 3A-3B.

Figure 4A:
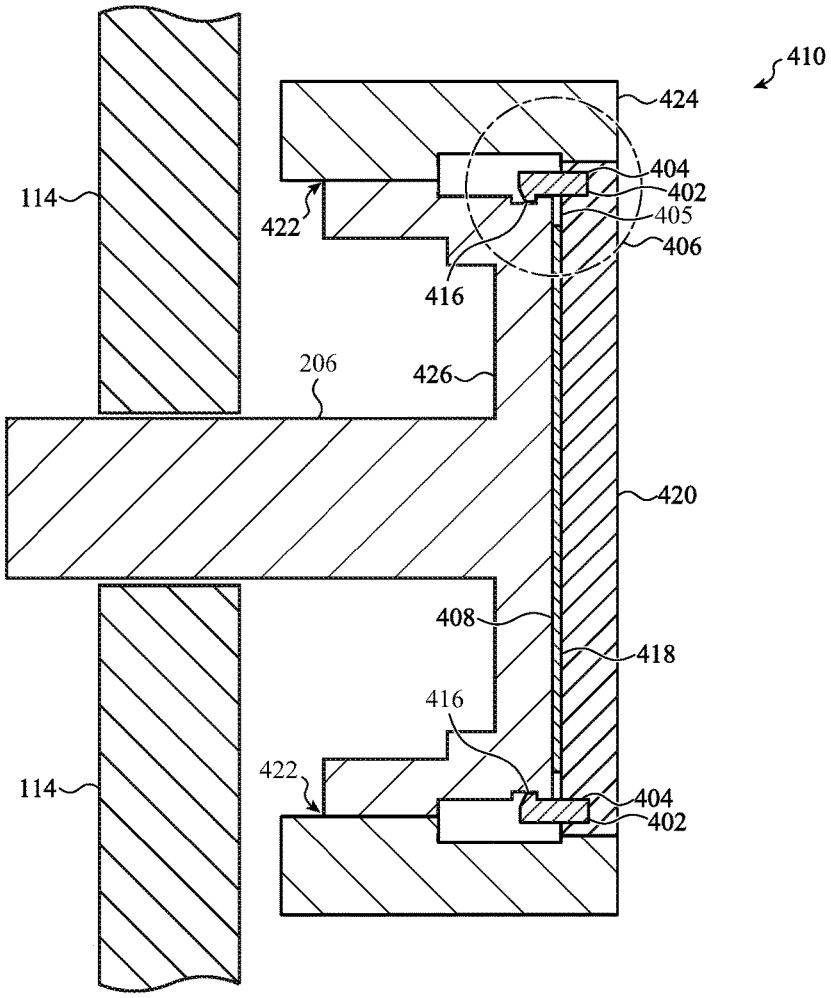
FIG. 4A shows a cross-sectional view of an example input assembly taken along section 2-2 of FIG. 1B.

FIG. 4A shows a cross-sectional view of a portion of an input assembly 410 in which retention clips 402 couple a cover member 420 to the input assembly 410. FIG. 4A depicts a cross-section similar to that in FIG. 2 (e.g., along section 2-2 in FIG. 1B).

Figure 6:
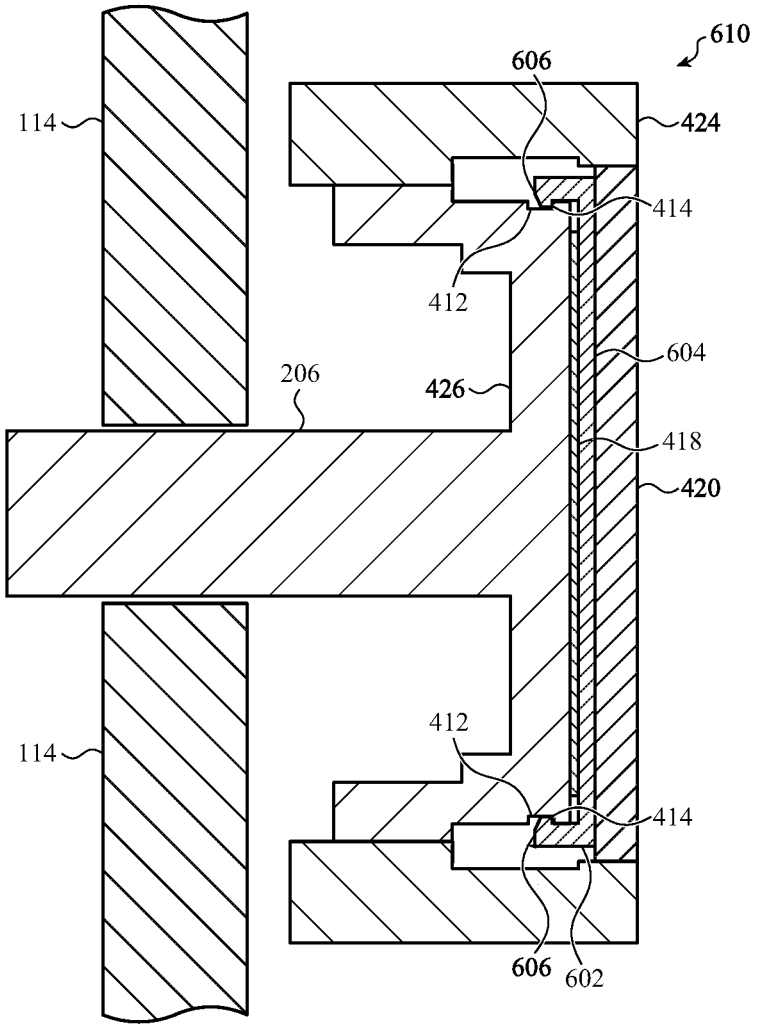
FIG. 6 shows a cross-sectional view of an example input assembly taken along section 2-2 of FIG. 1B.
Figure 7A:
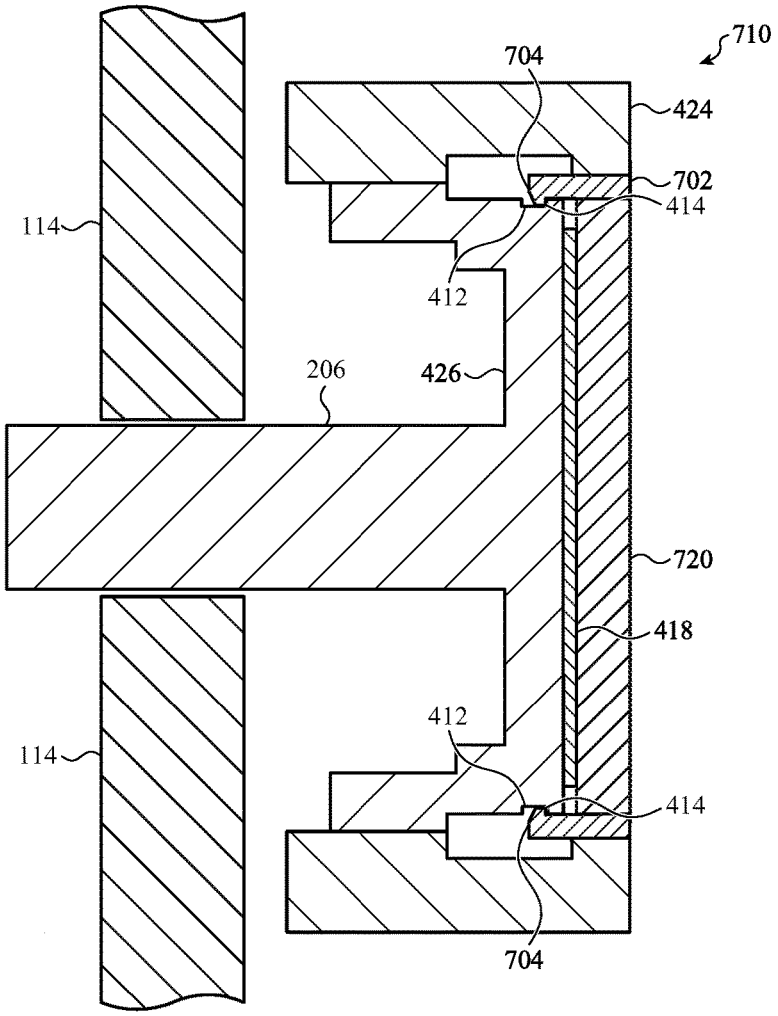
FIG. 7A shows a cross-sectional view of an example input assembly taken along section 2-2 of FIG. 1B.

The input assembly 410 is similar to the input assembly 110, and may provide the same or similar functionality and may be mounted to the electronic device 102 in the same or similar manner as the input assembly 110, described above. In the input assembly 110 in FIG. 2, the body 118 is a single, monolithic component. In FIGS. 4A, 6, and 7A, on the other hand, the body includes a base member 426 and a frame member 424, which together may define a recess into which the cover member 420 is at least partially positioned. The base member 426 and the frame member 424 may be coupled to one another along a bonding joint 422 via welding, brazing, soldering, interference fit, adhesive, interlocking structures (e.g., threads), or the like. As a result of the coupling, the base member 426 and the frame member 424 are fixed relative to one another, and thus both components rotate and/or translate in unison. Other techniques for coupling the base member 426 to the frame member 424 may be implemented instead of or in addition to those described herein.

The retention clips 402 engage a retention feature (such as an undercut 414, FIG. 4B) of the base member 426 to retain the cover member 420 to the input assembly 410. The retention clips 402 may be formed from any appropriate material, including steel, tungsten, titanium, aluminum, ceramics, polymers, or any other appropriate material. The retention clips 402 are one type of protruding member that may be used to retain the cover member 420 to the input assembly 410, though other protruding members may be used instead of or in addition to the retention clips 402.

Like the mounting arms 208 in FIG. 2, the retention clips 402 extend away or protrude from an inner surface 405 of the cover member 420 and may be attached to the cover member 420 by inserting portions (e.g., first ends) of the retention clips 402 into holes 404 (which may be blind holes, as shown) on the inner surface 405 of the cover member 420. The holes 404 may be any appropriate size or shape to accommodate the retention clips 402, including circular, arcuate, rectangular, square, etc. The retention clips 402 may be secured or fixed within the holes 404 via an interference fit, sintering, adhesive, or any other appropriate technique, as discussed above with respect to the mounting arms 208 of FIG. 2.

Figure 4B:
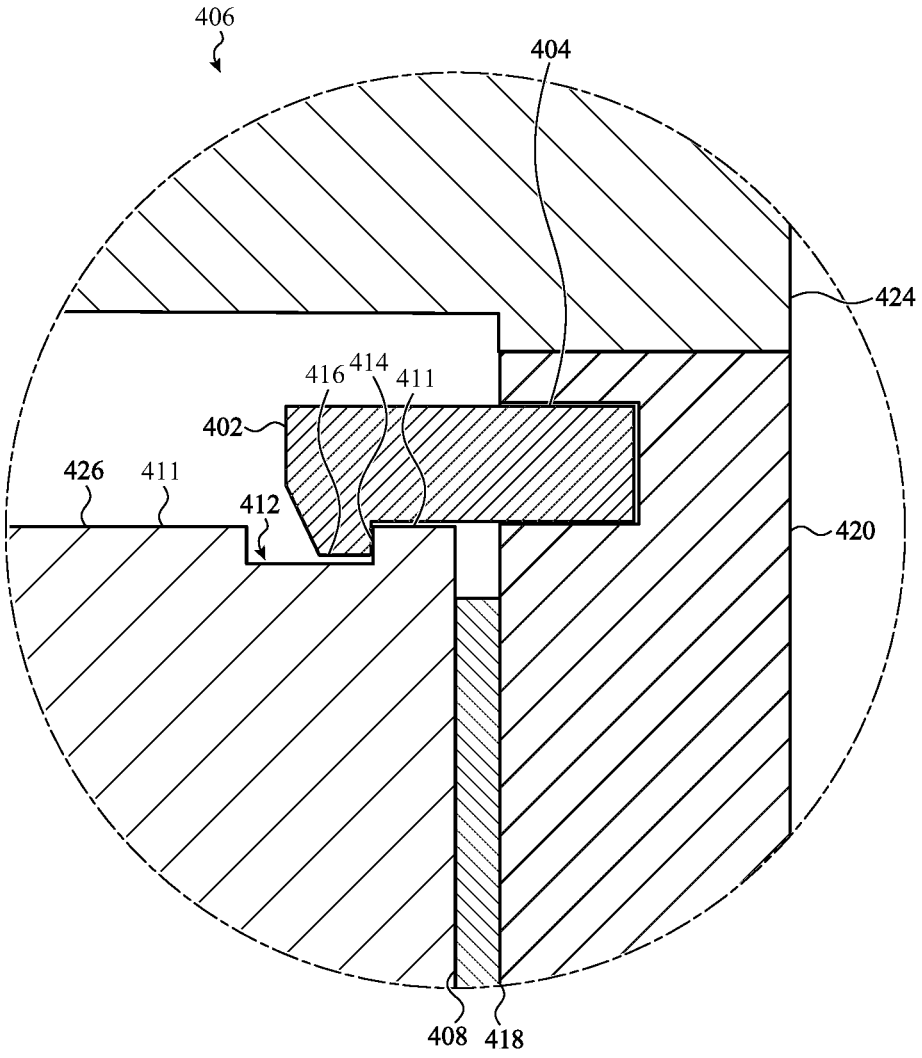
FIG. 4B shows a detail view of the input assembly of FIG. 4A.

FIG. 4B is a detail view of the area 406 of FIG. 4A. The base member 426 includes a mounting surface 408 and a sidewall 411, where the sidewall 411 defines at least a portion of an outer periphery of the base member 426. The sidewall 411 includes a channel 412 formed therein, with an opening of the channel 412 facing radially outward from the base member 426. The channel 412 includes a wall 414 that defines an undercut (also referred to herein as an undercut 414) that engages the retention clip 402 to couple the cover member 420 to the input assembly 410.

The retention clips 402 include catch members 416 at ends (e.g., second ends) of the retention clips 402 that engage the undercuts 414 (or any other appropriate retention feature), thereby retaining the cover member 420 to the base member 426. The retention clips 402 may snap over the rim of the base member 426 (e.g., the portion of the sidewall 411 between the channel 412 and the mounting surface 408) in order to engage the undercuts 414. In such cases, the retention clips 402 (and/or the catch members 416) are or include an elastically deformable material, such as a polymer, titanium, amorphous metal alloy, shape memory alloy, or the like, that allows the retention clips 402 to deflect so that the catch members 416 can pass over the rim and extend into the channels 412 to engage the undercuts 414. Alternatively or additionally, the base member 426 may include notches and channel profiles that allow the catch members 416 to enter the channels 412 and engage the undercuts 414 without requiring the retention clips 402. Details of such embodiments are described herein with reference to FIGS. 9A-10C.

The input assembly 410 may also include a biasing member 418 positioned between the cover member 420 and the base member 426 (or any other portion or component of the body 118). The biasing member 418 biases the cover member 420 away from the body 118, thus maintaining the engagement between the retention clips 402 and the undercuts 414 (e.g., by forcing the catch members 416 against the undercuts 414). Additionally, the biasing member 418 absorbs and dissipates the energy of impacts that may be imparted to the cover member 420, reducing the likelihood that an impact will break the cover member 120. The biasing member 418 may be a foam pad, an elastomer coating, one or more coil or leaf springs, or any other appropriate resilient material or component.

Like the embodiment shown in FIG. 2, the outer surface of the cover member 420 and the frame member 424 of FIGS. 4A and 4B form a substantially continuous and/or coplanar exterior surface of the input assembly 410, though other configurations are also possible. For example, the cover member 420 may be proud of or recessed from the frame member 424.

Figure 5A:
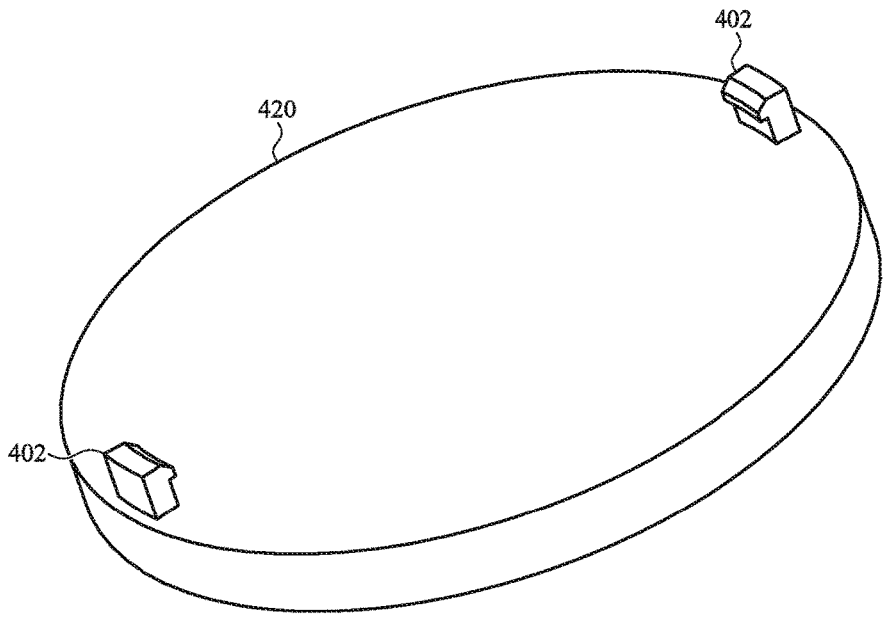
FIGS. 5A-5B show example cover members of the input assembly of FIG. 4A.
Figure 5B:
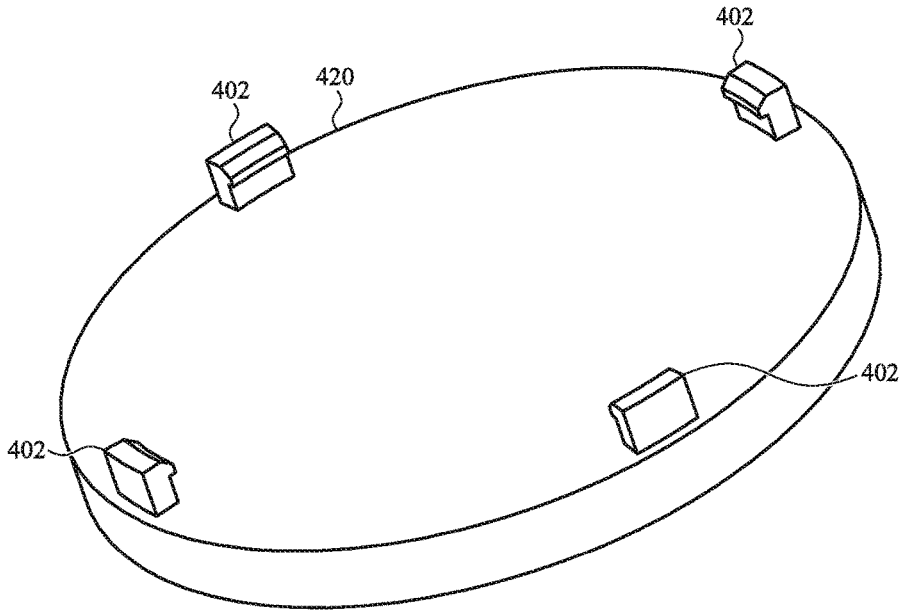

FIG. 5A shows an example arrangement of retention clips 402 on the cover member 420. In particular, two retention clips 402 are attached to the cover member 420 on the inner surface of the cover member 420. FIG. 5B is another example arrangement of retention clips 402, including four retention clips 402 arranged such that each retention clip 402 is located at a vertex of a square. The sizes and shapes of the retention clips 402 in FIGS. 5A-5B are merely examples, and clips of other sizes and shapes may be used instead of or in addition to those shown. Moreover, the retention clips 402 may be positioned on the cover member 420 in locations other than those shown in FIGS. 5A-5B.

FIG. 6 shows a cross-sectional view of an input assembly 610 in which a retention clip 602 is attached to the cover member 420 via a mounting plate 604. FIG. 6 depicts a cross-section similar to that in FIG. 2 (e.g., along section 2-2 in FIG. 1B).

In FIG. 6, the retention clip 602 includes protruding members, such as arms 606, attached to or otherwise integrated with a mounting plate 604, and the mounting plate 604 is coupled to the cover member 420. As shown, the mounting plate 604 and the arms 606 are integrally formed as a monolithic component. For example, the mounting plate 604 and the arms 606 may be molded (or cast, machined, or otherwise formed) as a unitary structure. The arms 606 and the mounting plate 604 may be formed from or include any appropriate material, such as polymers, ceramics, metal materials, or the like. In other embodiments (not shown), the arms 606 may be separate components that are attached or otherwise coupled to the mounting plate 604 via mechanical interlocks, adhesives, fasteners, or the like.

The mounting plate 604 may be coupled to the inner surface of the cover member 420 via an adhesive, such as a pressure sensitive adhesive (PSA), heat sensitive adhesive (HSA), or any other appropriate adhesive, glue, or bonding agent. Additionally or alternatively, the mounting plate 604 may be coupled to the inner surface of the cover member 420 via other techniques or with other components. For example, the mounting plate 604 may be fused with the cover member 420 via ultrasonic welding, sintering, or the like. In such cases, the mounting plate 604 may be formed from or include a material that can be fused to the material of the cover member 420, such as a metal material or a ceramic. In yet other examples, the mounting plate 604 may be coupled to the cover member 420 using other mechanisms, such as mechanical interlocks, co-molding, insert molding, or fasteners.

Other aspects of the input assembly 610, including the biasing member 418 and the manner in which the arms 606 (which may be similar to the retention clips 402) engage the base member 426 are described above with respect to FIGS. 4A-4B. For example, the arms 606 include catch members (similar to the catch members 416) that engage undercuts 414 (or another appropriate retention feature) of the base member 426 to retain the retention clip 602, and thus the cover member 420, to the base member 426.

Figure 7B:
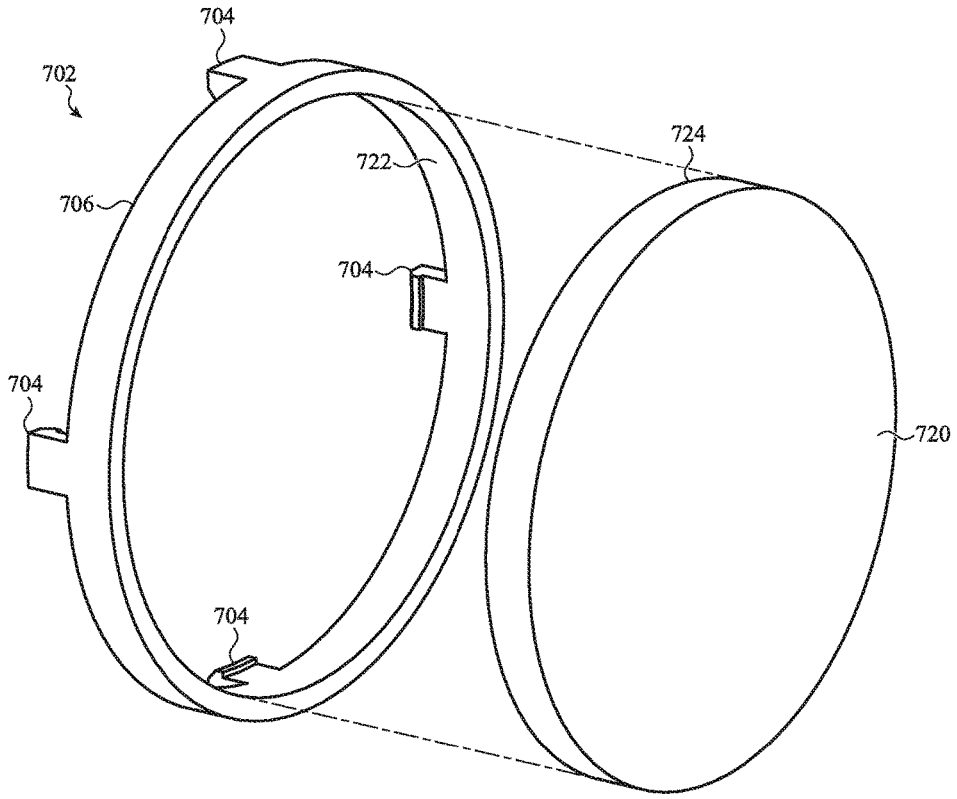
FIG. 7B shows a detail view of a cover member of the input assembly of FIG. 7A.

FIG. 7A is a cross-sectional view of an input assembly 710 in which a retention clip 702 is retained to the cover member 720 using a retention ring 706 (FIG. 7B) that at least partially surrounds the cover member 720. The retention clip 702 includes protruding members, such as arms 704, attached to or otherwise integrated with the retention ring 706 (FIG. 7B). FIG. 7A depicts a cross-section similar to that in FIG. 2 (e.g., along section 2-2 in FIG. 1B).

FIG. 7B shows the retention clip 702 detached from the cover member 720, illustrating how the cover member 720 may be coupled with the retention clip 702. For example, the cover member 720 may be positioned within the retention ring 706 such that an inner surface 722 of the retention ring 706 surrounds and engages a peripheral edge 724 of the cover member 720. The retention ring 706 thus couples the retention clip 702 and the arms 704 to the cover member 720 so that the cover member 720 can be retained to the base member 426.

The retention clip 702 may be coupled to the cover member 720 in any appropriate way, including interference fit, adhesive, clips, mechanical interlocks, or the like. Where an interference fit is used to retain the cover member 720 within the retention ring 706, the cover member 720 may be cooled such that the size of the cover member 720 is reduced in at least one direction (e.g., reducing the diameter of the cover member). The cooled cover member 720 is introduced into the retention ring 706 (e.g., such that the peripheral edge 724 of the cover member 720 is proximate the inner surface 722 of the retention ring 706) and allowed to return to ambient temperature, causing the cover member 720 to expand to its original size and thus forcing the peripheral edge 724 of the cover member 720 against the inner surface 722 of the retention ring 706. Alternatively or additionally, the retention ring 706 may be heated to expand its size (e.g., to increase an inner diameter of the retention ring 706) to allow the cover member 720 to be introduced therein. Once the retention ring 706 returns to ambient temperature, the retention ring 706 may be forced against the cover member 720, thus coupling the components together.

The arms 704 are coupled to or otherwise integrated with the retention ring 706. As shown in FIGS. 7A-7B, the retention ring 706 and the arms 704 are integrally formed as a monolithic component. For example, the retention ring 706 and the arms 704 may be molded (or cast, machined, or otherwise formed) as a unitary structure. The arms 704 and the retention ring 706 may be formed from or include any appropriate material, such as polymers, ceramics, metal materials, or the like.

FIG. 7B illustrates an embodiment in which four arms 704 are integrated with the retention ring 706; however, more or fewer arms 704 may be used. Moreover, the arms 704 may be any appropriate size. For example, the width of the arms 704 (e.g., a dimension of the arms 704 measured along a circumferential direction of the retention ring 706) may be less than or equal to about 5%, 10%, or 25% of the circumference of the retention ring 706.

Other aspects of the input assembly 710, including the biasing member 418 and the manner in which the arms 704 engage the base member 426 are described above with respect to FIGS. 4A-4B. For example, the arms 704 include catch members that engage undercuts 414 of the base member 426 to retain the retention clip 702 (and thus the cover member 720) to the base member 426.

Figure 8:
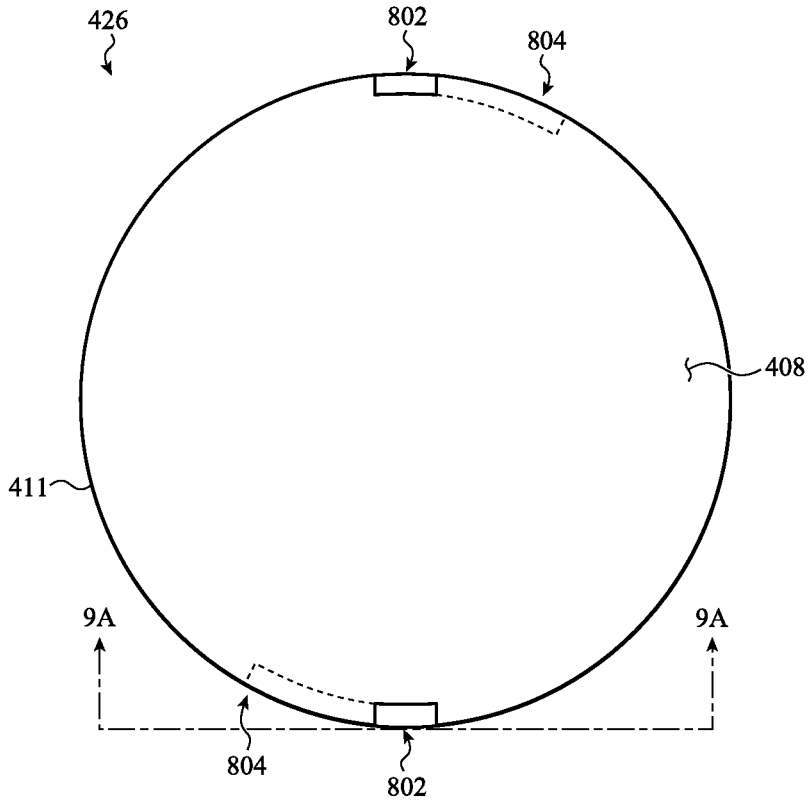
FIG. 8 shows an example base member of the input assembly of FIG. 4A.

FIG. 8 is a front view of the base member 426 of FIG. 4A, illustrating an embodiment of the base member 426 that is configured to couple to a cover member via two retention clips. For example, the base member 426 shown in FIG. 8 may be configured to couple to the cover member 420 shown in FIG. 5A via the two retention clips 402. The mounting surface 408 includes notches 802 in the peripheral portion of the mounting surface 408 that communicate with channels 804 formed into the sidewall 411 of the base member 426, and that allow retention clips (e.g., retention clips 402, 602, 702) to pass into the channels 804. The channels 804 extend away from the notches 802 in a circumferential direction such that catch members of retention clips (e.g., the catch members 416) can slide along the channels 804 and into areas away from the notches 802 (e.g., area 902, FIG. 9A). The channels 804 are one type of retention feature that may engage with mounting arms (e.g., the retention clips 402 or the arms of the retention clips 602 or 702) to retain a cover member to a body of an input or watch crown assembly, though other retention features may also be used.

Figure 9A:
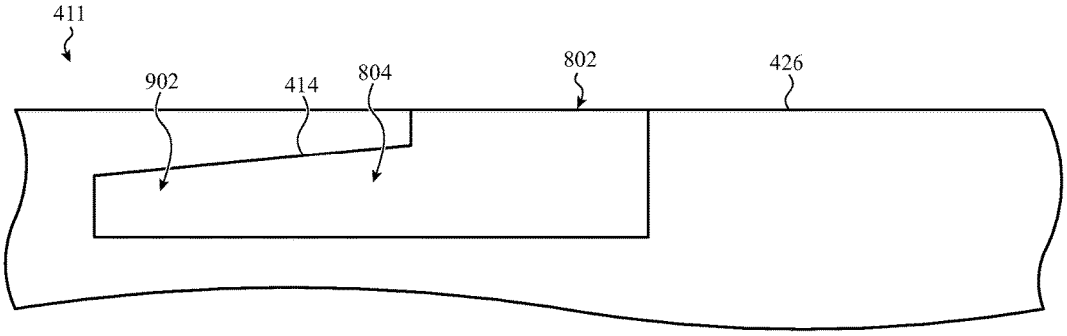
FIGS. 9A-9C show detail views of an example base member of the input assembly of FIG. 4A.

FIG. 9A shows a portion of the sidewall 411 of the base member 426, as viewed from line 9A-9A in FIG. 8, illustrating details of one embodiment of the channel 804. The channel 804 tapers along its length from an area proximate the notch 802 to an area away from the notch (e.g., area 902). To couple a cover member (e.g., the cover member 420, FIG. 4A) to the base member 426, a catch member 906 (FIGS. 9B-9C) of a retention clip is introduced into the channel 804 via the notch 802, and the cover member 420 is rotated to slide the catch member 906 into the narrow portion of the channel (area 902).

Figure 9B:
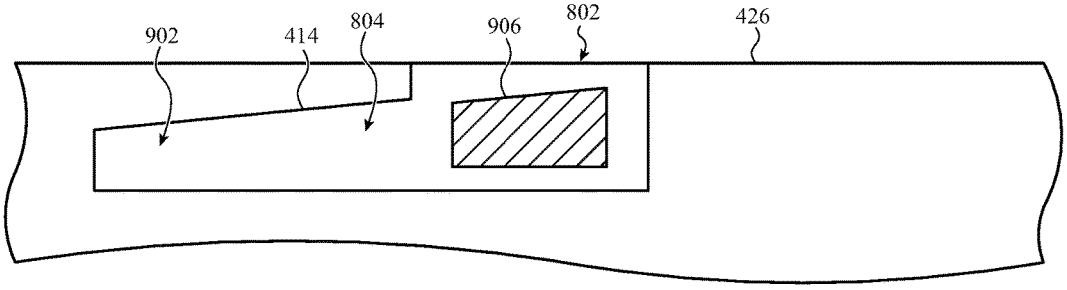
Figure 9C:
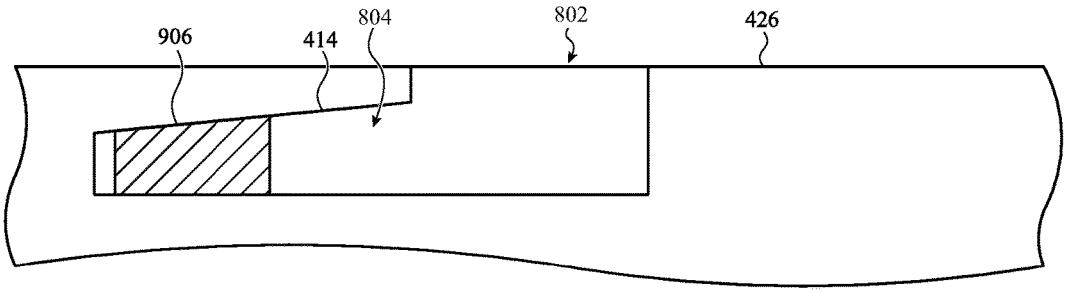

FIGS. 9B-9C illustrate a progression of the catch member 906 (shown in cross-section) being introduced into the channel 804 via the notch 802 (FIG. 9B), and being slid into the narrow portion of the channel 804 (FIG. 9C). When disposed in the narrow portion of the channel 804, opposing walls of the channel 804 are forced against surfaces of the catch member 906, thus preventing rotation of the cover member 420 with respect to the base member 426 and securely retaining the cover member 420 to the base member 426. Alternatively, instead of being compressed between opposing walls, the catch member 906 may engage only with one wall of the channel, such as the wall of the channel that forms the undercut 414. Indeed, in some embodiments, the base member 426 does not include a channel having opposing walls, but only the undercut 414, which may be a flange or other structure that extends from the sidewall 411 of the base member 426. The catch member 906 shown in FIGS. 9B-9C may be a catch member of any retention clip described herein, such as the retention clips 402, 602, or 702.

Figure 10A:
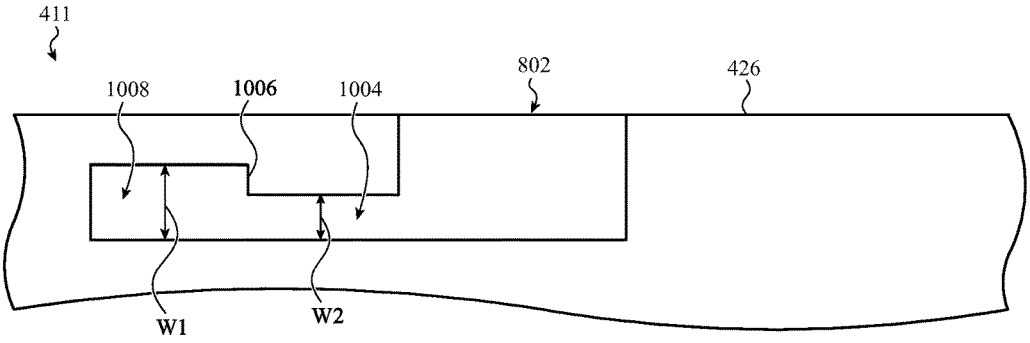
FIGS. 10A-10C show detail views of an example base member of the input assembly of FIG. 4A.

FIG. 10A shows a portion of the sidewall 411 of the base member 426, as viewed from line 9A-9A in FIG. 8, illustrating details of a channel 1004, which may be used instead of or in addition to the channel 804. (For example, one channel of a particular base member 426 may have a configuration similar to the channel 804, and another may have a configuration similar to the channel 1004.) The channel 1004 includes a locking surface 1006 that extends into the channel 1004 and partially encloses or defines an area 1008. The area 1008 has a first width W1, and a portion of the channel 1004 between the area 1008 and the notch 802 has a second width W2 that is smaller than the first width. The locking surface 1006 prevents a catch member 1002 (FIGS. 10B-10C) from sliding within the channel 1004 after the cover member 420 is coupled to the base member 426, and thus retains the cover member 420 to the base member 426.

Figure 10B:
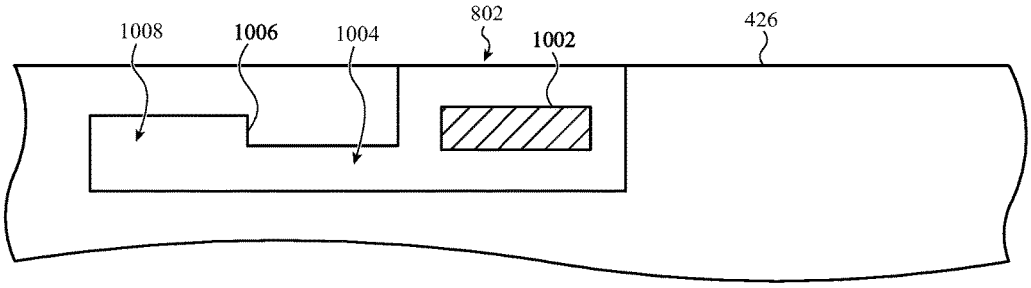
Figure 10C:
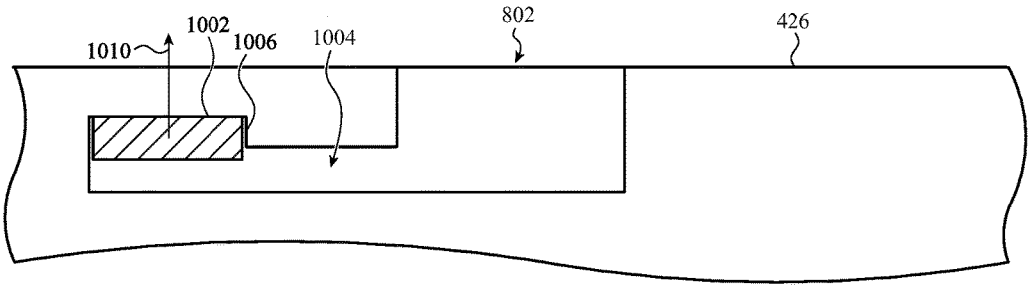

FIGS. 10B-10C illustrate a progression of the catch member 1002 (shown in cross-section) being introduced into the channel 1004 via the notch 802 (FIG. 10B), and being slid into the area 1008 of the channel 1004 beyond the locking surface 1006 (FIG. 10C). The catch member 1002 may be biased against the undercut 414, thus maintaining the catch member 1002 in an overlapping configuration with the locking surface 1006. The catch member 1002 thus engages the locking surface 1006 and prevents rotation of the cover member 420 with respect to the base member 426. A biasing force maintaining the catch member 1002 against the undercut 414 (represented by arrow 1010) may be provided, for example, by the biasing member 418 disposed between the cover member 420 and the base member 426.

While the locking surface 1006 is shown within the channel 1004 (e.g., a channel that is at least partially enclosed by several opposing walls), the same principle of operation may apply to embodiments where the base member 426 does not include the channel 1004. For example, the base member 426 may include the undercut 414 and the locking surface 1006, but may not have any wall or structure that opposes or faces the undercut 414 to define a channel. In such cases, the undercut 414 may appear as a flange or other extension from the sidewall 411. Moreover, the catch member 1002 shown in FIGS. 10B-10C may be a catch member of any retention clip described herein, such as the retention clips 402, 602, or 702.

Figure 11:
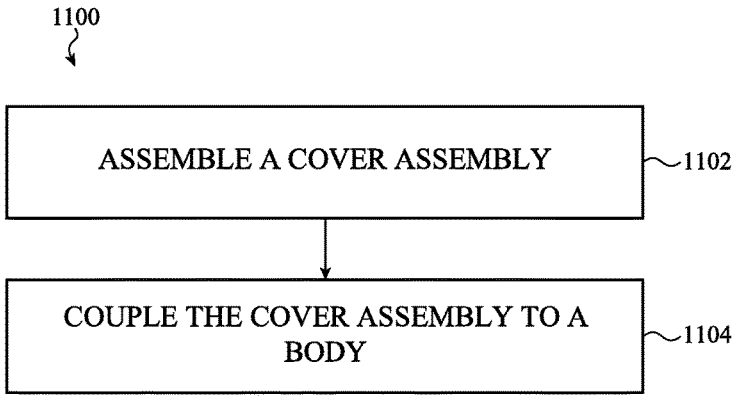
FIG. 11 shows an example processes for assembling an input assembly.

FIG. 11 is a flow chart of a method 1100 of assembling an input assembly, such as the input assembly 110 described above. At operation 1102, a cover assembly is assembled. As used herein, a cover assembly includes a cover member (e.g., the cover member 120, 420, or 720) and one or more mounting structures (e.g., the mounting arms 208 or the retention clips 402, 602, 702). Cover assemblies may include additional components as well.

With respect to operation 1102, assembling the cover assembly includes attaching, securing, or otherwise coupling a mounting structure to the cover member. For example, a mounting structure, such as a mounting arm or a retention clip, may be inserted into an opening in a cover member and secured therein. The mounting structure may be secured within the opening in various ways. In one example, the mounting structure may be secured in the opening using an interference fit. This may include reducing a temperature of the mounting structure such that the mounting structure reduces size in at least one direction. For example, the mounting structure may be cooled until a diameter (or other appropriate dimension) of the mounting structure is reduced enough to fit into the opening. The mounting structure is then inserted into the opening and allowed to return to ambient temperature. When the mounting structure returns to ambient temperature, it returns to its original size and presses against the walls of the opening, thus securing the mounting structure to the cover member.

Another technique for producing an interference fit between the mounting structure and the opening includes increasing the temperature of the cover member such that the opening in the inner surface of the cover member increases size in at least one direction. For example, the cover member, or a portion thereof, may be heated by a laser, an oven/furnace, hot air, flame, or any other appropriate technique, resulting in the opening expanding sufficiently for the mounting structure to be inserted into the opening. After inserting the mounting structure, the cover member is allowed to return to ambient temperature, causing the opening to contract such that the walls of the opening press against the mounting structure, thereby securing the mounting structure to the cover member. Either or both of the foregoing techniques (e.g., heating the cover member and cooling the mounting structure) may be used to change the relative sizes of the mounting structure and the opening to allow clearance for insertion of the mounting structure.

In some cases, the mounting structure and the cover member are formed from or include materials that can fuse together when one or both of the materials are heated, in which case the mounting structure may be sintered with the cover member to attach the mounting structure to the cover member. For example, the mounting structure (e.g., a post, cylinder, column, clip, arm, or other protruding member) may be inserted into an opening in the cover member, or otherwise placed in contact with the cover member. One or both of the mounting structure and the cover member may then be heated, resulting in the material of the mounting structure fusing with the material of the cover member.

The foregoing sintering process may be used where the cover member is formed from zirconia and the mounting structure is formed from tungsten, though other materials may also be used. For example, sintering may be used to join the cover member and the mounting structure when the cover member is formed from any of glass, zirconia, sapphire, diamond, chemically toughened glass, borosilicate glass, metal materials, ceramic, or any other appropriate material, and when the mounting structure is formed from any of tungsten, stainless steel, titanium, ceramic, amorphous metal alloy, or any other appropriate material.

Where the mounting structure is or includes a retention clip with a mounting plate (such as the retention clip 602, FIG. 6), the operation of assembling the cover assembly (operation 1102) may include applying an adhesive to one or both of the mounting plate and an inner surface of the cover member, and placing the mounting plate in contact with the inner surface of the cover member. The adhesive may then be allowed to cure (e.g., by application of heat and/or pressure, or by the passage of time), thus securing the mounting structure to the cover member. In some cases, instead of adhesive, the mounting plate may be ultrasonically welded to the cover member.

Another technique for attaching a retention clip with a mounting plate to the cover member includes insert molding the retention clip onto the cover member by inserting the cover member into a mold cavity and molding the retention clip directly onto the cover member. The molding process both forms the retention clip and bonds the retention clip (e.g., via the mounting plate) to the cover member.

Where the mounting structure is or includes a retention clip with a retention ring (e.g., the retention clip 702), the operation of assembling the cover assembly (operation 1102) may include positioning the cover member inside the retention ring and securing the retention ring to the cover member. For example, as described above, the retention ring may be secured to the cover member by an interference fit. The interference fit may be formed by expanding the retention ring (e.g., by heating the retention ring) and/or shrinking the cover member (e.g., by cooling the cover member), placing the cover member inside the retention ring, and allowing the retention ring and/or the cover member to return to ambient temperature.

At operation 1104, the cover assembly is coupled to a body of the input assembly (e.g., the body 118). Coupling the cover assembly to the body may include inserting the mounting structure into an opening in the body. For example, the body may include an opening (e.g., a through hole) that is configured to receive the mounting structure (e.g., the mounting arm 208).

After inserting the mounting structure into an opening in the body, the mounting structure may be welded to the body. Welding may be used where the materials of the mounting structure and the body are compatible for welding. In such cases, a distal end of the mounting structure (relative to the cover member) and the portion of the body near the distal end of the mounting structure may be laser welded, friction welded, arc welded or otherwise fused together to couple the components. Because the mounting structure is also secured to the cover member, welding the mounting structure to the body secures the cover member to the mounting structure, thus reducing the chance that the cover member will become detached from the input assembly.

In some cases, instead of or in addition to welding, an adhesive secures the mounting structure to the body. For example, an epoxy or other bonding agent may be applied to one or both of the body (e.g., within an opening or hole in the body) and the mounting structure to secure the cover member to the body.

The mounting structure may be staked to the body. For example, the distal end of the mounting structure may be configured to extend through an opening in the body and protrude beyond a surface of the body. The protruding portion may be deformed to form a mechanical interlock between the mounting structure and the body. More particularly, the distal end of the mounting structure may be deformed into a feature that has a larger diameter than the opening through which the mounting structure extended. Thus, the feature retains the mounting structure and, by extension, the cover member, to the body. Because staking does not require fusing the material of the mounting structure to the material of the body, staking may be employed where the materials of the mounting structure and the body are not compatible for welding, or where welding is otherwise not desirable.

Where the mounting structure is a retention clip (e.g., the retention clips 402, 602, 702), coupling the cover assembly to the body (operation 1104) may include engaging a retention clip with retention features of the body, such as undercuts. As shown and described with respect to FIGS. 9A-9C, engaging a retention clip with undercuts of the body may include inserting catch members into channels formed in a sidewall of the body (e.g., the channels 804, 1004), and rotating the cover assembly to move catch members along the channels such that the catch members engage with the undercuts. In embodiments where the channels include opposing walls, moving the catch members along the channels may cause the catch members to be squeezed between the opposing walls of the channel. The friction and pressure between the opposing walls and the catch members increase the force required to rotate the cover assembly toward a decoupled (or more loosely coupled) position, and thus increase the strength and security of the coupling between the cover member and the body. As another example, coupling the cover assembly to the body may include inserting catch members into widenings of channels in a sidewall of the body, as shown and described with respect to FIGS. 10A-10C.

The method 1100 optionally includes placing a biasing member (e.g., the biasing member 418, FIG. 4A) between the cover assembly and the body. The biasing member may be a foam pad, an elastomer coating, one or more coil or leaf springs, or any other appropriate resilient material or component. The biasing member may be adhered to the cover assembly and/or the body, or it may be disposed between these components without any adhesives or bonding agents. As described above, the biasing member may bias catch members of a retention clip against undercuts of the body (e.g., the undercuts 414) to retain the cover assembly to the body.

Although particular methods of assembly have been described above, it is understood that these are merely example methods and processes. In various implementations, the same, similar, and/or different components may be assembled in a variety of orders (and with more or fewer steps or operations) without departing from the scope of the present disclosure.

Figure 12:
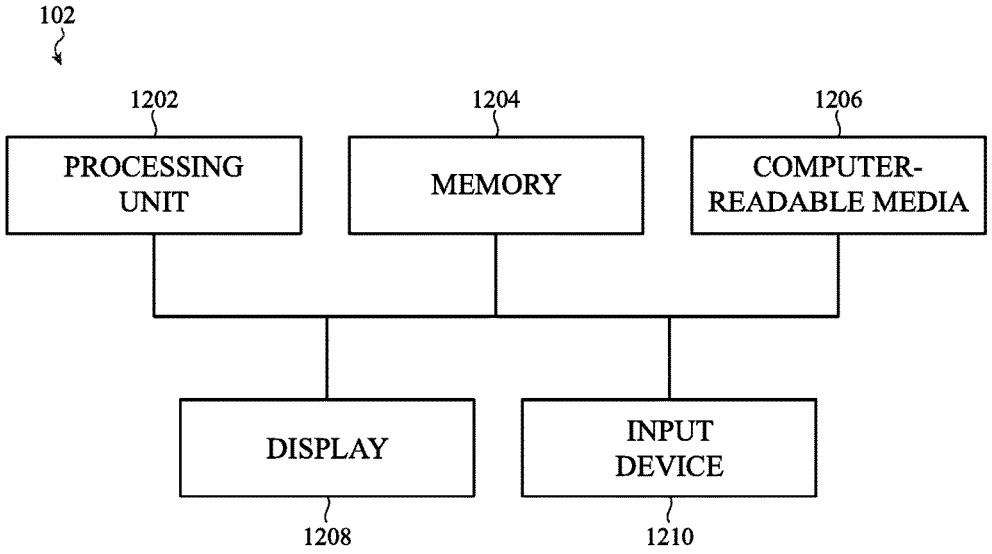
FIG. 12 shows an example electronic device having an input assembly.

FIG. 12 depicts an example electronic device having an input assembly. The schematic representation depicted in FIG. 12 may correspond to components of the electronic devices described above, including the device 102 depicted in FIGS. 1A-1B. However, FIG. 12 may also more generally represent other types of devices that are configured to use an input assembly as described herein.

As shown in FIG. 12, a device 102 includes a processing unit 1202 operatively connected to computer memory 1204 and computer-readable media 1206. The processing unit (or processor) 1202 may be operatively connected to the memory 1204 and computer-readable media 1206 components via an electronic bus or bridge. The processing unit 1202 may include one or more computer processors or microcontrollers that are configured to perform operations in response to computer-readable instructions. The processing unit 1202 may include the central processing unit (CPU) of the device. Additionally or alternatively, the processing unit 1202 may include other processors within the device including application specific integrated circuit (ASIC) and other microcontroller devices.

The memory 1204 may include a variety of types of non-transitory computer-readable storage media, including, for example, read access memory (RAM), read-only memory (ROM), erasable programmable memory (e.g., EPROM and EEPROM), or flash memory. The memory 1204 is configured to store computer-readable instructions, sensor values, and other persistent software elements. Computer-readable media 1206 also includes a variety of types of non-transitory computer-readable storage media including, for example, a hard-drive storage device, solid state storage device, portable magnetic storage device, or other similar device. The computer-readable media 1206 may also be configured to store computer-readable instructions, sensor values, and other persistent software elements.

In this example, the processing unit 1202 is operable to read computer-readable instructions stored on the memory 1204 and/or computer-readable media 1206. The computer-readable instructions may adapt the processing unit 1202 to perform operations described above, such as presenting a user interface on a display, and performing user-interface actions (e.g., changing the user interface or changing a parameter of the device) in response to inputs received by an input assembly. The computer-readable instructions may be provided as a computer-program product, software application, or the like.

As shown in FIG. 12, the device 102 also includes a display 1208, which may correspond to the display 116, and an input device 1210. The display 1208 may include a liquid-crystal display (LCD), organic light emitting diode (OLED) display, light emitting diode (LED) display, or the like. If the display 1208 is an LCD, the display may also include a backlight component that can be controlled to provide variable levels of display brightness. If the display 1208 is an OLED or LED type display, the brightness of the display may be controlled by controlling the electrical signal that is provided to display elements.

The input device 1210 is configured to provide user input to the device 102. The input device 1210 may include, for example, crowns (e.g., watch crowns), buttons (e.g., power buttons, volume buttons, home buttons, camera buttons), scroll wheels, and the like. The input device 1210 may include an input assembly (e.g., the input assembly 110, 410, 610, or 710) to be physically manipulated by a user, as well as any appropriate sensors or other components to detect physical inputs to the input assembly, such as rotations and/or translations of the input assembly. The input device 1210 may include other input devices, such as a touch screen, touch button, keyboard, key pad, or other touch input device.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not targeted to be exhaustive or to limit the embodiments to the precise forms disclosed. It will be apparent to one of ordinary skill in the art that many modifications and variations are possible in view of the above teachings.

What is claimed is:

1. A smartwatch, comprising:
a housing; and
a crown positioned along a sidewall of the housing, the crown comprising:
a body external to the housing and defining:
a first portion of an exterior surface of the crown; and
an attachment surface at least partially defining a recess in the body;
a sapphire cap positioned at least partially within the recess and defining a second portion of the exterior surface of the crown; and
an adhesive fixedly attaching the sapphire cap to the attachment surface.

2. The smartwatch of claim 1, further comprising:
a display positioned within the housing; and
a processor configured to:
present a user interface on the display;
perform a first user-interface action in response to a detection of a first type of manipulation of the crown; and
perform a second user-interface action different from the first user-interface action in response a detection of a second type of manipulation of the crown.

3. The smartwatch of claim 2, wherein:
the first type of manipulation corresponds to a rotation of the crown; and
the second type of manipulation corresponds to a translation of the crown.

4. The smartwatch of claim 1, wherein:
the body defines a retention feature; and
the crown further comprises a mounting structure engaged with the retention feature.

5. The smartwatch of claim 4, wherein:
the retention feature is an opening in the body; and
the mounting structure extends at least partially into the opening.

6. The smartwatch of claim 1, wherein a portion of the sapphire cap defining the second portion of the exterior surface of the crown has a convex shape.

7. The smartwatch of claim 1, further comprising a touch screen display coupled to the housing and configured to receive touch-based inputs.

8. A wearable electronic device, comprising:
a housing;
a touch-screen display positioned at least partially within the housing;
a crown attached to the housing and configured to control an operation of the wearable electronic device in response to a detection of a manipulation of the crown, the crown comprising:
a body at least partially defining a peripheral surface of the crown;
a cap at least partially defining an end surface of the crown and comprising a retention feature engaged with the body; and
an adhesive bonding the cap to the body.

9. The wearable electronic device of claim 8, wherein the retention feature comprises a clip that mechanically engages the body.

10. The wearable electronic device of claim 8, further comprising a band attached to the housing and configured to attach the wearable electronic device to a user.

11. The wearable electronic device of claim 8, wherein:
the wearable electronic device further comprises a rotation sensor; and
the manipulation of the crown produces a rotation of the crown that is detected by the rotation sensor.

12. The wearable electronic device of claim 8, wherein the crown further comprises a shaft extending at least partially into an internal volume of the housing.

13. The wearable electronic device of claim 8, wherein:
the body is formed of a metal material; and
the cap is formed of sapphire.

14. The wearable electronic device of claim 8, wherein:
the body is formed of a metal material; and
the cap is formed of polymer.

15. A wearable electronic device, comprising:
a housing; and
a crown positioned along a side of the housing and comprising:
a body defining:
an end surface; and
a recess in the end surface; and
a cap formed of a different material than the body and positioned at least partially within the recess, wherein the cap is bonded to the body via an adhesive.

16. The wearable electronic device of claim 15, wherein:
the body is formed of a metal material; and
the cap is formed of sapphire.

17. The wearable electronic device of claim 16, wherein the crown further comprises a retention arm that is attached to the sapphire and mechanically engaged with the body.

18. The wearable electronic device of claim 15, wherein:
the body is formed of metal;
the cap is formed of polymer; and
the cap further comprises a retention feature mechanically engaged with the body.

19. The wearable electronic device of claim 18, wherein:
the body defines an undercut feature; and
the retention feature comprises a clip that is mechanically engaged with the undercut feature.

20. The wearable electronic device of claim 15, wherein a surface of the cap is substantially flush with the end surface of the body.

* * * * *